US011345503B2

(12) United States Patent
Bevilacqua

(10) Patent No.: US 11,345,503 B2
(45) Date of Patent: May 31, 2022

(54) MACHINE FOR APPLYING LABELS OR OTHER MARKINGS TO CONTAINERS

(71) Applicant: Accraply, LLC, A Barry-Wehmiller Packaging Company, Brooklyn Park, MN (US)

(72) Inventor: Giovanni Bevilacqua, Castellucchio (IT)

(73) Assignee: ACCRAPLY, LLC, Brooklyn Park, MN (US)

( * ) Notice: Subject to any disclaimer, the term of this patent is extended or adjusted under 35 U.S.C. 154(b) by 0 days.

(21) Appl. No.: 17/130,828

(22) Filed: Dec. 22, 2020

(65) Prior Publication Data

US 2021/0197995 A1 Jul. 1, 2021

Related U.S. Application Data

(60) Provisional application No. 62/954,777, filed on Dec. 30, 2019.

(51) Int. Cl.
*B65C 9/04* (2006.01)
*B65C 9/06* (2006.01)
(Continued)

(52) U.S. Cl.
CPC ..... *B65C 9/04* (2013.01); *B65C 3/065* (2013.01); *B65C 9/06* (2013.01); *B65C 9/40* (2013.01);
(Continued)

(58) Field of Classification Search
CPC .. B65C 9/04; B65C 3/065; B65C 9/06; B65C 9/40; B65C 2009/407; B65C 2009/408;
(Continued)

(56) References Cited

U.S. PATENT DOCUMENTS 5,185,053 A * 2/1993 Tomashauser ..... B65C 9/04 156/487
6,550,512 B2 4/2003 Lewis
(Continued)

FOREIGN PATENT DOCUMENTS

WO WO-2019049032 A1 * 3/2019 ..... B65C 9/06
WO WO/2019/159117 8/2019
(Continued)

OTHER PUBLICATIONS

International Search Report PCT/US20/66675.
Written Opinion of the International Searching Authority PCT/US20/666675.

*Primary Examiner* — George R Koch
(74) *Attorney, Agent, or Firm* — Ralph E. Jocke; Walker & Jocke

(57) ABSTRACT

A machine (10, 224, 258, 274, 292, 310) is selectively operative to apply markings such as labels, sleeves, decorations and indicia to containers (58, 130, 162, 254). The machine includes a lower conveyor (LC) (14) and an upper conveyor (UC) (28). LC shuttles (46) are selectively movable around an LC track (16). UC shuttles (52) are selectively movable around a UC track (30). The LC and UC shuttles are selectively movable to engage a container vertically intermediate of respective LC and UC shuttles. In the container engaged position each container is selectively rotatably and linearly movable so as to be positioned in engagement with applicators (108, 256, 296, 298, 300, 314, 316, 318, 320, 322, 324). The applicators are selectively operative to apply markings to respective containers in operative engagement therewith in a precise and repeatable manner.

48 Claims, 22 Drawing Sheets

(51) Int. Cl.
*B65C 3/06* (2006.01)
*B65C 9/40* (2006.01)

(52) U.S. Cl.
CPC .. *B65C 2009/407* (2013.01); *B65C 2009/408* (2013.01)

(58) Field of Classification Search
CPC .... B65G 2201/0244; B65G 2201/0247; B65G 47/244; B65G 47/84; B65G 47/842; B65G 47/845
See application file for complete search history.

(56) References Cited

U.S. PATENT DOCUMENTS 6,998,006 B1 * 2/2006 Kessler ..... B65C 3/14 156/230
8,156,987 B1 4/2012 Yang
8,991,589 B2 3/2015 Marcantoni et al.
9,499,292 B2 11/2016 Herrmann
10,214,310 B2 2/2019 Marcantoni
2002/0096260 A1 * 7/2002 Yang ..... B65C 9/40 156/351
2005/0265881 A1 * 12/2005 Davidson ..... B65C 9/04 418/61.3
2006/0037706 A1 * 2/2006 Putzer ..... B65C 9/06 156/360
2006/0070850 A1 * 4/2006 Hartness ..... B65G 47/5104 198/468.2
2009/0133593 A1 * 5/2009 Till ..... B41J 11/0021 101/35
2018/0170596 A1 6/2018 Marcantoni
2018/0362269 A1 * 12/2018 Marcantoni ..... B65G 47/244
2019/0092511 A1 * 3/2019 Casadio ..... G06T 7/70

FOREIGN PATENT DOCUMENTS

WO WO-2019159117 A1 * 8/2019 ..... B65C 9/04
WO WO/2020/001987 2/2020
WO WO/2020/001990 2/2020

* cited by examiner

MACHINE FOR APPLYING LABELS OR OTHER MARKINGS TO CONTAINERS

TECHNICAL FIELD

Exemplary arrangements relate to machines that are operative to apply labels or other markings to containers. Exemplary arrangements are particularly applicable to machines that may operate to label or mark containers having varied configurations and sizes.

BACKGROUND

Containers that are made of plastic, glass or metal are commonly used to hold liquid or solid materials. Such containers commonly require markings thereon to indicate the contents of the container as well as the brand or other source of the material. Such markings may commonly be in the form of labels which are uniformly applied to the containers. Such labels may be in the form of paper or plastic sheets or sleeves that are applied to the containers using adhesives or other attachment methods. Other markings often found on containers include indicia which indicates information such as the particular facility or operation that produced the material, the date the material was produced and/or a "use by" or expiration date associated with the material. Such indicia may be included on a label that is applied to the container or alternatively applied to the container by a stamp, an inkjet or other printing methods. Containers may also include other types of markings for decorative or informational purposes. Containers may be completely painted with specific direct color printers and/or may be printed with images. A single container may have several different kinds of markings applied thereto through differing types of marking methods.

Machines that apply markings to containers need to be able to accurately and repeatedly apply markings to the containers at generally high rates of speed to match production rates. Many types of automated equipment can be used to apply labels or other markings to containers of particular types. Some types of machines include devices that transport containers on a rotary carousel and apply labels and other markings during the time that the containers are being transported. Some types of such machines require time consuming changes in components and operation set up in order to handle different sizes and types of containers. In some cases machines used for labeling and marking containers are limited in terms of the types, sizes and configurations of containers that can be handled by the machine for purposes of applying markings thereto.

Machines used for applying labels or other markings to containers may benefit from improvements.

SUMMARY

Exemplary arrangements relate to machines that may be used to apply labels or other markings to containers such as bottles, jars and cans. The exemplary machines include a lower conveyor (LC) and an upper conveyor (UC). In the exemplary arrangement the LC includes a continuous LC track that extends in a vertical plane. The UC includes a UC track that extends coplanar with the LC track. The exemplary LC track includes an LC labeling track portion that extends substantially linearly straight and horizontally. The UC track includes a UC labeling track portion that extends parallel to and in vertically aligned relation with at least a portion of the LC labeling track portion. In exemplary arrangements the LC track and the UC track are operatively mounted to a common frame which includes a jack. The jack is selectively adjustable to change the vertical distance between the LC labeling track portion and the UC labeling track portion to readily accommodate handling containers having different vertical dimensions.

A plurality of LC shuttles are operable to move about the LC track. In an exemplary arrangement each of the LC shuttles is operable to move along the track independently of the other LC shuttles. In other exemplary arrangements LC shuttles may move in mechanically joined relation with other LC shuttles through engagement with a continuous drive chain or other movable member. A plurality of UC shuttles are movable on the UC track. In an exemplary arrangement the UC shuttles are similarly independently movable about the UC track. In other exemplary arrangements UC shuttles may move in mechanically joined relation with other UC shuttles. The exemplary LC shuttles each include a container engagement platform that is configured to engage and support a bottom end of only one single container. The exemplary UC shuttles may each include a container engagement fixture that is configured to engage an upper portion of only one single container. At least one of the exemplary container engagement platform and the container engagement fixture are in operative connection with a drive. The drive is selectively operative to rotate the respective platform or fixture so as to rotatably move and position the container in engagement therewith for purposes of applying labels or other markings thereto.

At least one applicator is positioned adjacent to the LC and UC labeling track portions. The at least one applicator is operative to apply markings to containers in operative engagement with the applicator. The exemplary applicator may be operative to apply labels such as sheets or sleeves to containers or to print or apply indicia or other markings to containers that are moved in engagement with LC and UC shuttles into operative engagement with the applicator. A plurality of applicators may be spaced along the LC labeling track portion so that multiple different types of markings may be applied to a single container.

In an exemplary arrangement containers such as bottles are fed into the machine. The controller of the machine is operative responsive to position sensors to engage a respective container with a respective LC shuttle and a respective UC shuttle in a position adjacent to the inlet ends of the respective LC and UC labeling track portions. The container is engaged in a shuttle engaged position in which the container extends vertically between and in operative engagement with each of the respective LC and UC shuttles. In the shuttle engaged position the container is moved in a first direction toward the at least one applicator.

In the exemplary arrangement the controller operates responsive to feature sensors which are operative to sense at least one feature of the container, to cause a drive to rotate the container through rotation of the container engagement platform and the container engagement fixture to a desired angular reference position for the application of a label or other markings by the applicator. The container is then moved in the shuttle engaged position into operative connection with the applicator which operates to apply the markings to the container. In some exemplary arrangements the controller may operate to rotate the container while in operative engagement with the applicator to enable the desired marking of the container.

After the container has been marked with the markings by the applicator, the container may be moved in the shuttle engaged position in the first direction into operative connection with a subsequent applicator to receive additional markings and/or adjacent to at least one optical sensor that senses features that can be used to determine if the markings have been properly applied to the container. Further movement in the first direction causes the container to be released by the shuttles from the shuttle engaged position so that the container may be further processed.

Of course it should be understood that the features and functions described herein are exemplary and in other arrangements other features, functions and capabilities may be provided by machines that utilize aspects of the described arrangements.

DETAILED DESCRIPTION

Figure 1:
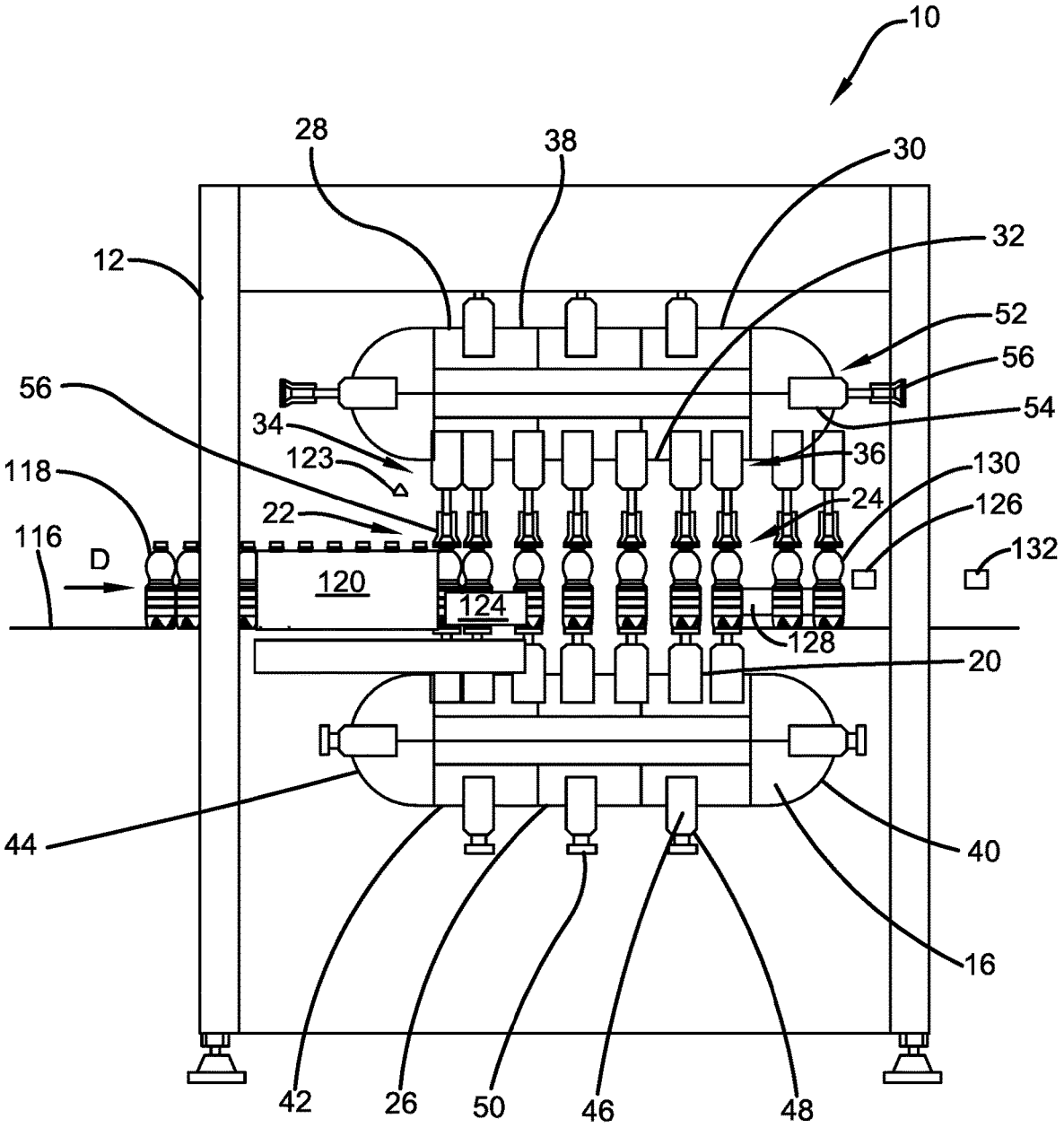
FIG. 1 is a schematic front view of an exemplary arrangement of a machine for applying labels or other markings to containers.
Figure 2:
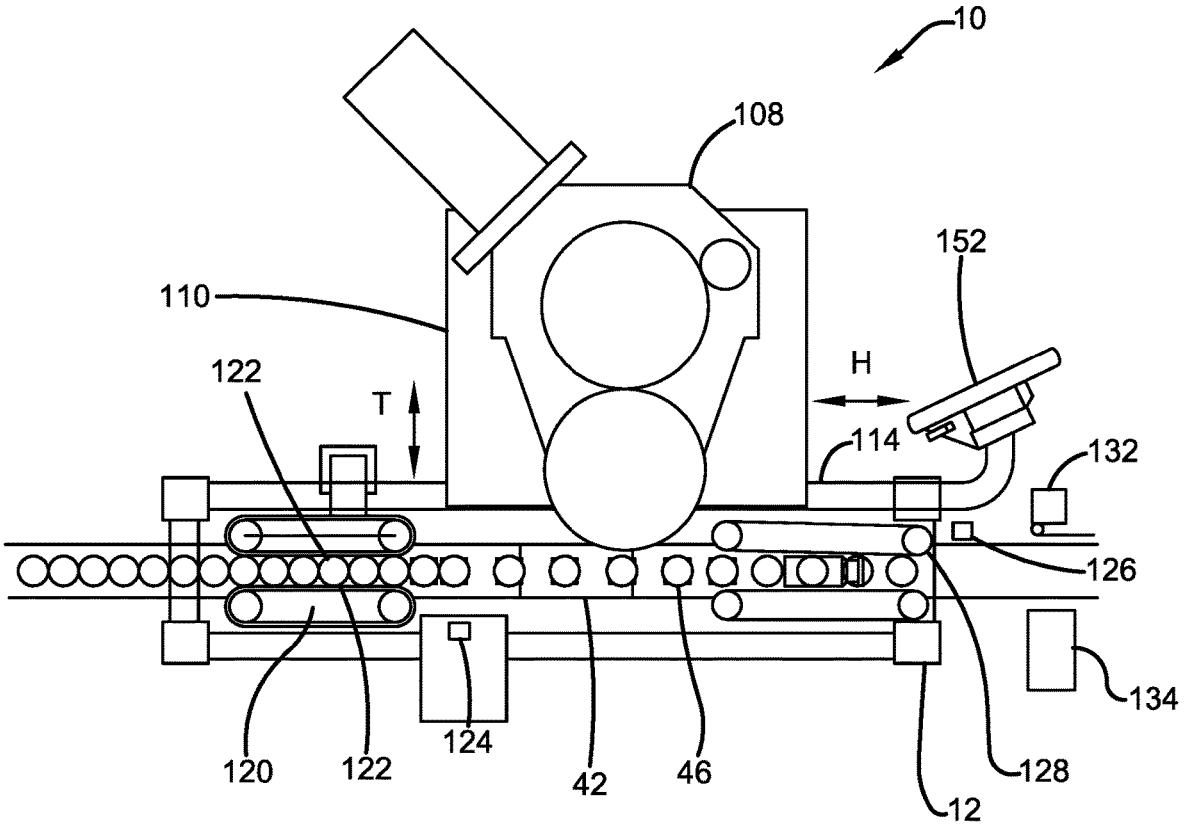
FIG. 2 is a top view of the machine shown in FIG. 1.
Figure 3:
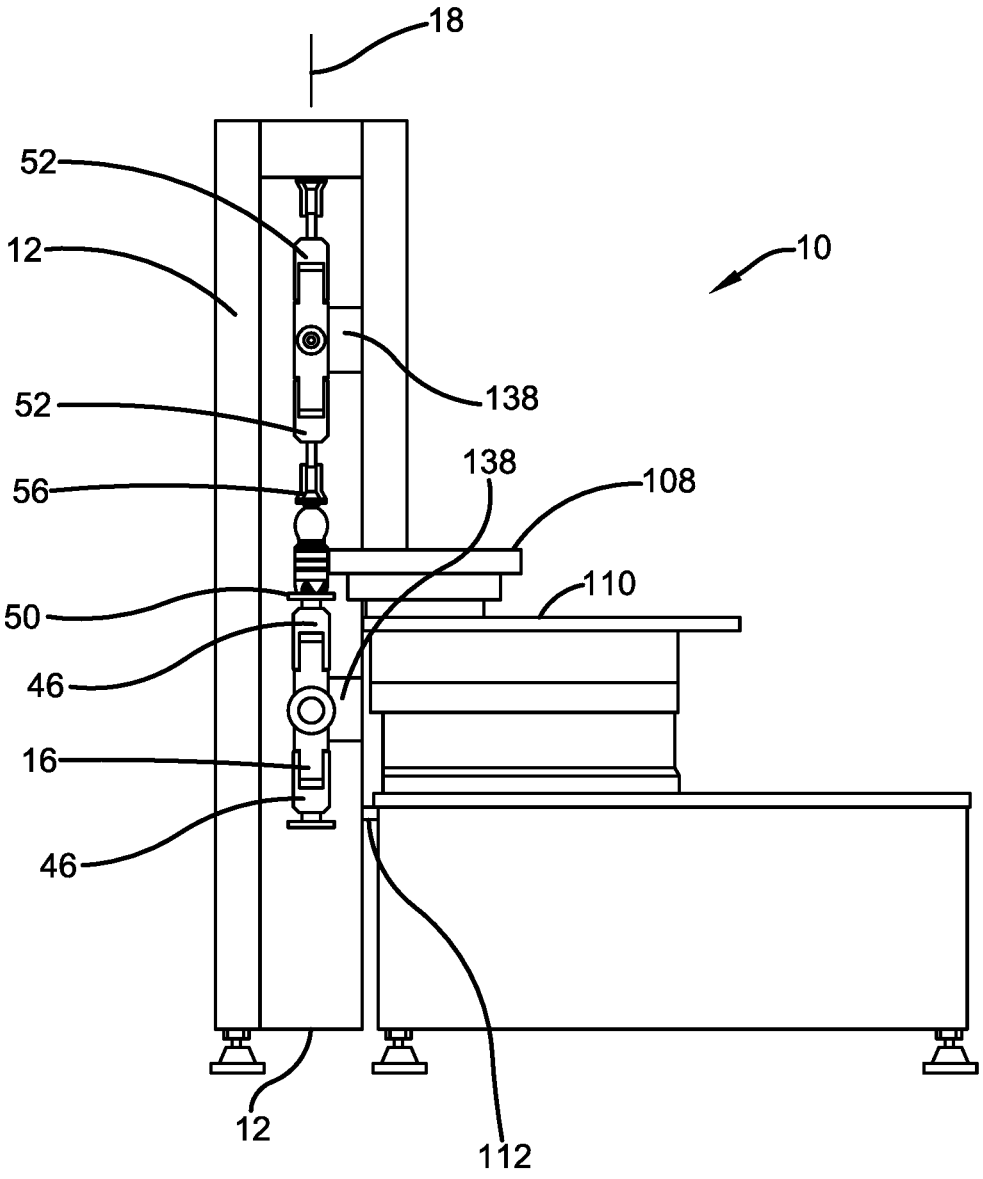
FIG. 3 is a right side view of the machine shown in FIG. 1.

Referring now to the drawings and particularly to FIG. 1 there is shown therein an exemplary machine 10. The exemplary machine 10 is usable to apply markings to containers such as bottles, jars and cans that may be used to house solid or liquid materials. For purposes hereof markings shall be deemed to refer to labels such as paper or plastic patches or sheets, or sleeves that are applied to containers and are attached to containers by adhesives or other fastening methods, as well as indicia or decoration that is printed, sprayed or otherwise applied directly onto a container surface or a label surface. Such markings applied to containers may be informational, decorative or both.

The exemplary machine includes a frame 12. Frame 12 is in operative supported connection with a lower conveyor (LC) 14. The LC includes a continuous LC track 16. In the exemplary arrangement the exemplary LC track has an oval shape and extends in generally a vertically extending plane 18. The LC track includes a substantially linearly straight horizontally extending LC labeling track portion 20. The LC labeling track portion 20 extends at the upper side of the LC track 16. The LC labeling track portion 20 extends between an LC inlet end 22 and an LC outlet end 24. LC track 16 further includes a return LC track portion 26. The return LC track portion extends vertically below the LC labeling track portion. The return LC track portion 26 extends between the LC outlet end 24 and the LC inlet end 22. Of course it should be understood that this configuration is exemplary and in other arrangements other approaches may be used.

The exemplary machine further includes an upper conveyor (UC) 28. UC 28 includes a continuous UC track 30. The exemplary UC track 30 has an oval configuration similar to the LC track 16. UC track 30 also extends substantially in vertical plane 18. UC track 30 includes a UC labeling track portion 32. UC labeling track portion 32 extends vertically above and in aligned relation with at least a portion of the LC labeling track portion 20. The UC labeling track portion extends between a UC inlet end 34 and a UC outlet end 36. UC track 30 further includes a return UC track portion 38. The return UC track portion extends above the UC labeling track portion 32 and between the UC outlet end 36 and the UC inlet end 34. Of course it should be understood that this configuration is exemplary and other arrangements other configurations may be used.

In the exemplary arrangement shown in FIG. 1, the LC track and the UC track are comprised of a plurality of modular track pieces 40. Track pieces include a plurality of straight track pieces such as straight track piece 42. The track pieces further include a plurality of curved track pieces such as curved track piece 44. In the exemplary arrangement the straight and curved track pieces are assembled in adjacent relation to provide the LC track and the UC track. Further in exemplary arrangements different numbers of straight track pieces 42 and curved track pieces 44 may be included in the LC and/or UC tracks in order to provide different lengths for the LC labeling track portion and/or UC labeling track portion along which markings may be applied to containers and other functions performed.

In the exemplary arrangement shown in FIG. 1 a plurality of LC shuttles 46 are movable about the LC track. In the exemplary arrangement each LC shuttle 46 includes a body 48. Each LC shuttle body is in movable engagement with the LC track 16. In exemplary arrangements each LC shuttle body 48 may be engaged to the LC track by rollers, tabs, projections, magnets or other suitable structures that are operative to hold the shuttle body in operative engagement with the LC track. Of course it should be understood that in some arrangements the LC track may include projections, recesses, rails, magnets or other structures that operate to hold the LC shuttle body in movable operative engagement with the LC track. The exemplary LC shuttle further includes a container engagement platform 50.

Figure 8:
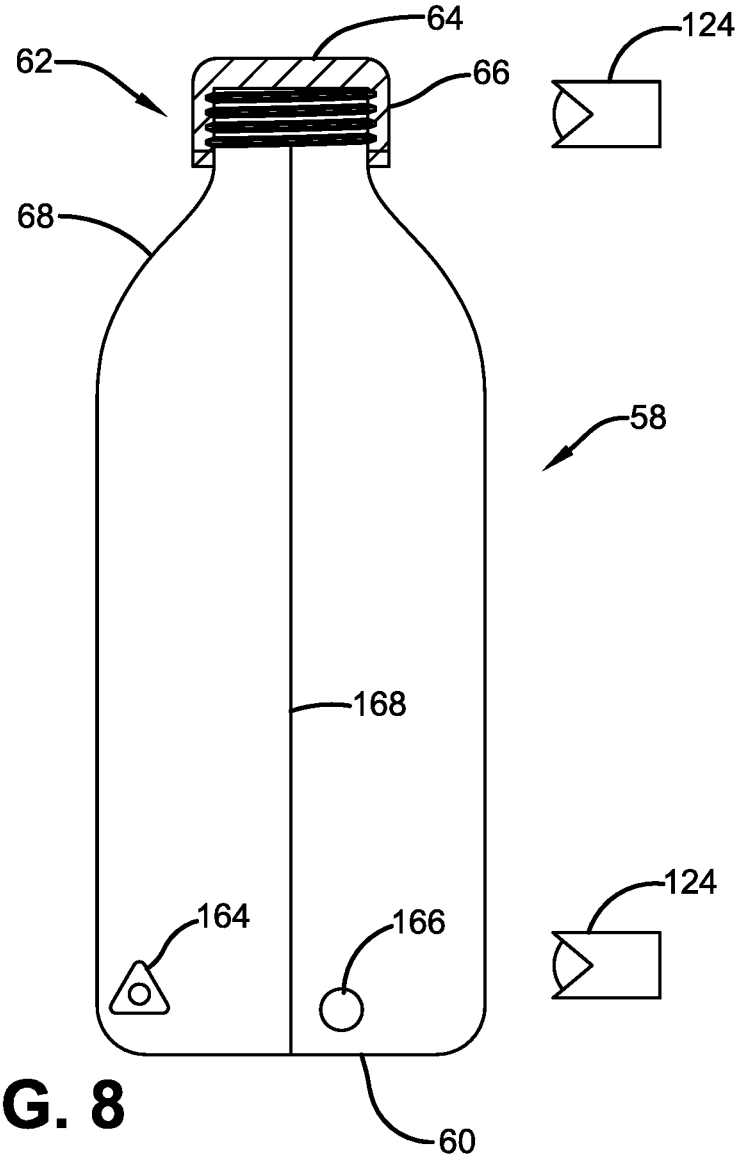

The exemplary container engagement platform 50 is rotatably movably mounted in operative connection on a respective LC shuttle body 48. The exemplary container engagement platform 50 is configured to engage in operatively supported connection a bottom end of only one single container that is to undergo marking by the machine. FIG. 8 shows an example of a container 58 that has a bottom end 60. The container engagement platform 50 is configured to be selectively rotatably movable in ways that are hereinafter discussed so as to selectively angularly position the container that is in supported engagement therewith so as to assure the proper marking of the container.

The exemplary machine further includes a plurality of UC shuttles 52. The exemplary UC shuttles each include a UC shuttle body 54. The exemplary UC shuttle bodies 54 are configured to move about the UC track 30 in a manner similar to the movement of the LC shuttles about the LC track. Each UC shuttle 52 has a container engagement fixture 56 in rotatably movably mounted operative connection with the respective UC shuttle body. The exemplary container engagement fixture is configured to biasingly engage an upper portion of a container that is disposed upwardly from the bottom end of the container. For example in some exemplary arrangements the container engagement fixture may engage an upper portion 62 adjacent a top 64 of a container such as a cap 66 or lid of a container. In other arrangements the container engagement fixture may be configured to engage a neck 68 or other area of the upper portion of the container. Further it should be understood that while in the exemplary arrangements the container engagement fixture is configured to be rotatably movably mounted on the UC shuttle body, in other arrangements the container engagement fixture may be stationary relative to the shuttle body, but may enable the one container that is engaged therewith to rotationally move in operative engagement with the fixture. Of course it should be understood that these arrangements are exemplary and in other arrangements other approaches may be used.

In exemplary arrangements the LC track and/or the UC track are configured to enable each LC shuttle and/or UC shuttle on the respective track to be moved independently in a controlled manner and independently of the movement of other LC shuttles and UC shuttles on the respective track. For example in some exemplary arrangements one or both of the LC track and UC track may comprise a electromagnetic track which comprises a plurality of spaced electromagnetic elements that are operative to move respective LC shuttles and/or UC shuttles through variable magnetic force. In such arrangements the respective shuttles include magnetic type shuttle drives which are operative to cause the respective shuttle to move responsive to the varied magnetic fields that are generated in the coils or other magnetic elements that comprise the track and/or the shuttle. For example in some arrangements systems providing selective movement of shuttles responsive to changeable magnetic force may be utilized that are commercially available from B & R Industrial Automation GmbH of Eggelsberg, Austria, Rockwell Automation, Inc of Milwaukee, Wis. and Beckhoff Automation GmbH & Co. KG of Vert, Germany. In other arrangements conveyor types may be utilized that include movable shuttles which have or which are in connection with shuttle drives that are operative to selectively move the shuttles on a respective track through rotation of wheels, rollers, belts, tracks, balls or movement of other controlled moving members.

Figure 18:
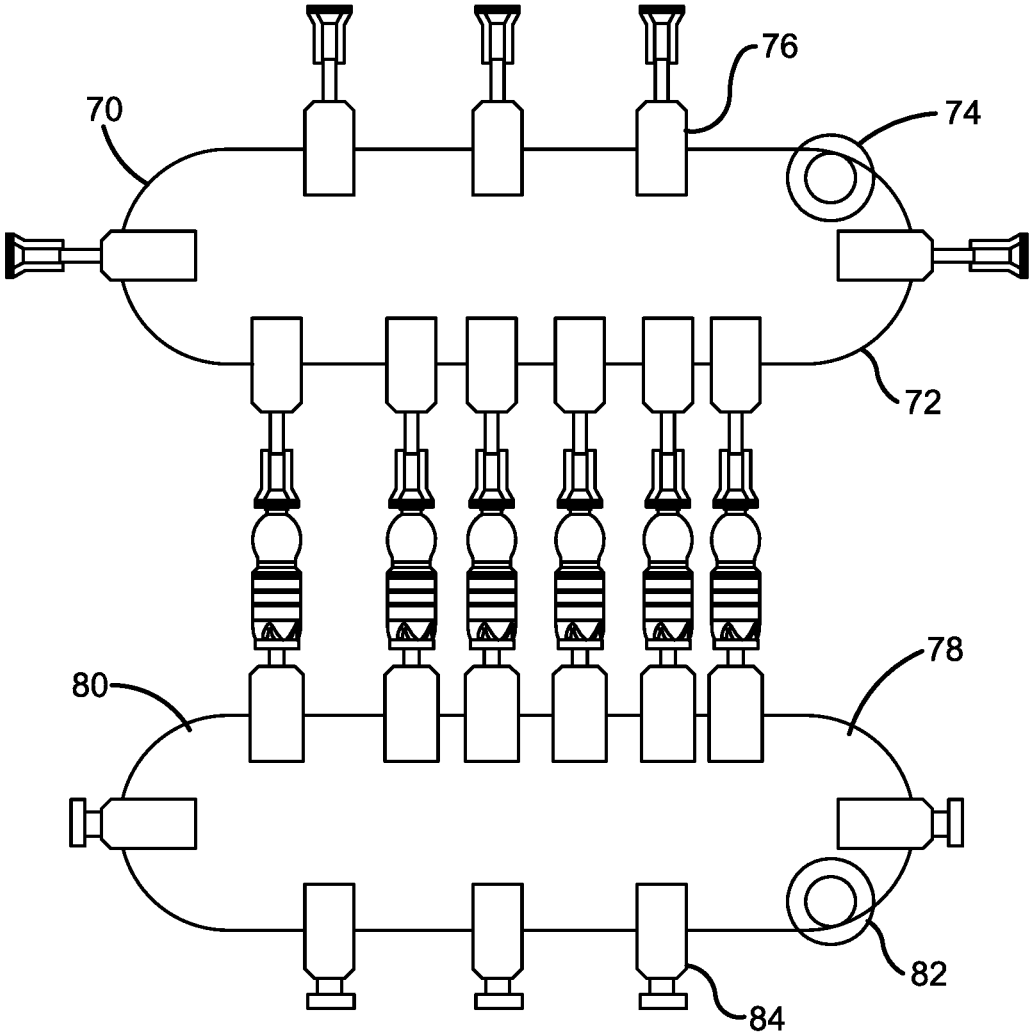
FIG. 18 schematically shows an alternative arrangement including a lower conveyor track and the upper conveyor track which each have a respective continuous drive chain to which the respective LC shuttles and UC shuttles are operatively engageable to provide movement thereof along the respective LC track or UC track.

In other exemplary arrangements the respective conveyor track may include a movable continuous drive chain which is operative to extend substantially about the conveyor track. Such a drive chain 70 is shown on a UC track 72 in the arrangement shown FIG. 18. A motor 74 is in operative connection with the drive chain 70 and is operative to selectively move the drive chain. The UC shuttles 76 are in operative connection with the drive chain 70 such that the UC shuttle 76 can move responsive to movement of the drive chain. Similarly a continuous drive chain 78 extends substantially about an LC track 80. A motor 82 is selectively operative to move the drive chain 78. LC shuttles 84 are in operative connection with the drive chain 78 and are movable about the LC track responsive to operation of the motor 82. In some arrangements the shuttles may have levers, hooks, clutches or other actuators that enable selective operative engagement and disengagement of each shuttle and the drive chain. Of course it should be understood that these approaches to moving the respective LC and UC shuttles described herein are exemplary and in other arrangements other approaches may be used.

Figure 7:
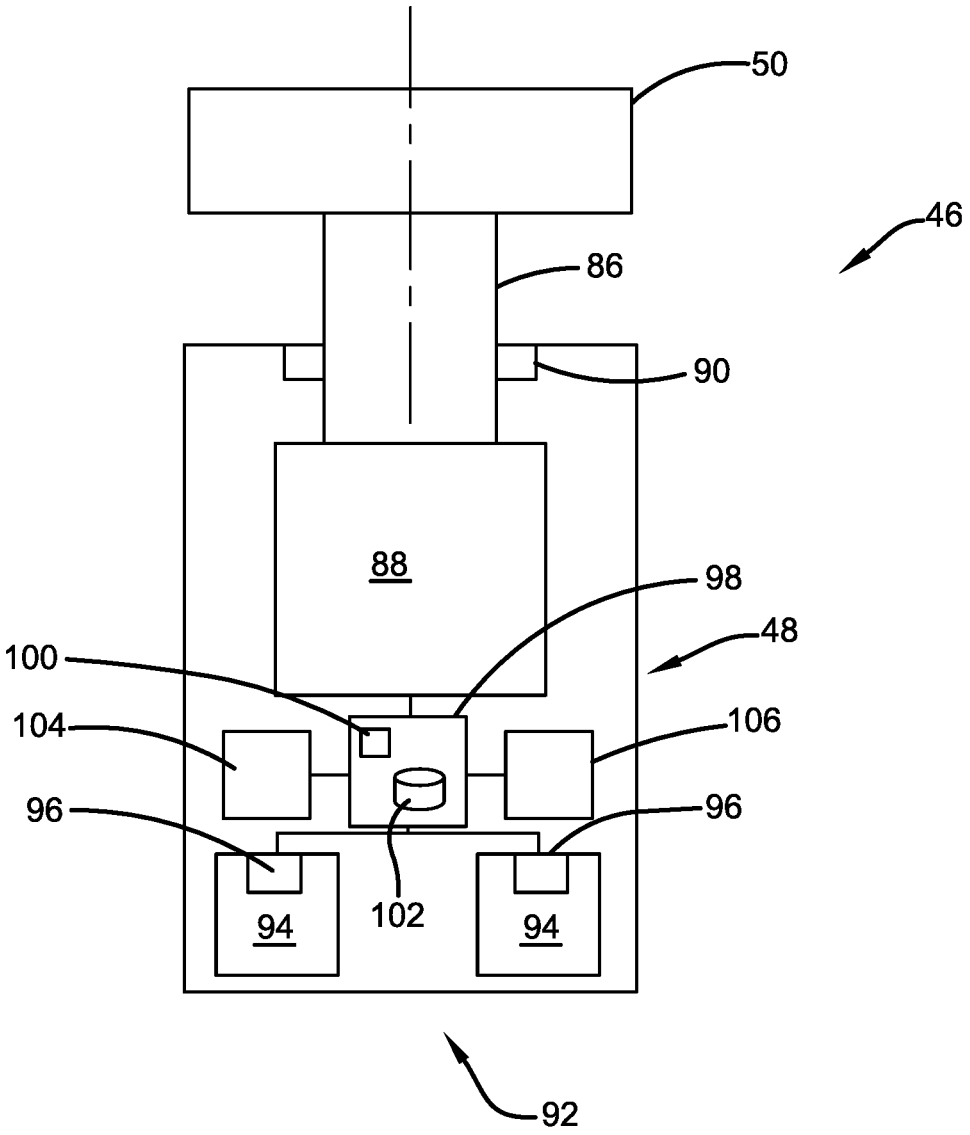
FIG. 7 is a transparent schematic view of components included in an exemplary LC shuttle.

An exemplary LC shuttle is shown schematically in FIG. 7. In the exemplary arrangement the container engagement platform 50 of the shuttle is supported on a rotatable shaft 86 that is in operative connection with a drive 88. In this exemplary arrangement the drive 88 includes an electrically powered motor such as a servo motor that is housed within the LC shuttle body 48. However in other arrangements other types of drives that are usable to selectively rotate the container engagement platform may be used. In the exemplary arrangement the shaft 86 is in supported journaled connection with at least one bearing 90.

The exemplary shuttle 46 further includes a shuttle drive 92. In an exemplary arrangement that uses a magnetic type shuttle drive, the shuttle includes at least two magnetic elements 94. The exemplary shuttle includes sensors 96. In an exemplary arrangement the sensors 96 are operative to provide signals that can be utilized for purposes of determining a current location of the shuttle body on the track. Such sensors may include for example, optical sensors, magnetic sensors, inductance sensors, physical contact sensors or other suitable sensors that can detect suitable encoder markings or other features that can be utilized for purposes of determining the shuttle location. Of course these components and approaches are exemplary and in other arrangements other shuttle drive components, sensors and other features and approaches may be used.

The exemplary shuttle further includes a shuttle controller 98. The exemplary shuttle controller includes at least one circuit including a processor 100 and at least one data store 102. In the exemplary arrangement the processor may include a processor suitable for carrying out circuit executable instructions that are stored in the at least one data store 102. The processor may include or be in connection with a nonvolatile storage medium including instructions that include a basic input/output system (BIOS). For example, the processor may correspond to one or more or combination of a CPU, FPGA, ASIC or other integrated circuit or other type of circuit that is capable of processing data and instructions. The data store may correspond to one or more of volatile or nonvolatile memory such as random access memory, flash memory, magnetic memory, optical memory, solid-state memory or other device that is operative to store circuit executable instructions and data. Circuit executable instructions may include instructions in any of a plurality of programming languages and formats including, without limitation, routines, subroutines, programs, threads of execution, objects, methodologies, scripts and functions which may carry out the actions such as those described herein. Structures for processors and associated circuitry may include, correspond to, and/or utilize the principles described in the textbook entitled Microprocessor Architecture, Programming and Applications with the 8085 by Ramesh S. Gaonker (Prentice Hall, 2002) which is incorporated herein by reference in its entirety.

The exemplary data store used in connection with exemplary embodiments may include any one or more of several types of mediums suitable for holding nontransitory circuit executable instructions. This may include for example, magnetic media, optical media, solid-state media or other types of media such as RAM, ROM, PROM, flash memory, computer hard drives or some other form of media suitable for holding data and circuit executable instructions. Exemplary controllers may include other components such as hardware and/or software interfaces for communication with the other components of the shuttle or other components of the machine.

The exemplary shuttle 46 further includes a power supply component 104. In some exemplary arrangements the power supply component 104 comprises one or more batteries or other power cells. In other exemplary arrangements the power supply component 104 may comprise a power supply interface which is configured to connect with a power cable or other source of electrical power for purposes of powering the shuttle components. Further in other exemplary arrangements the power supply component may further include components associated with charging the battery such as an inductive charging circuit or other wireless or wired charging circuit suitable for charging the batteries within the shuttle. Other power supply components may include power storage devices such as capacitor circuitry or other circuitry that maintains data storage and/or is sufficient to enable the shuttle to move to a set location or change to suitable idle condition if power is lost.

The exemplary shuttle further includes an interface component 106. In exemplary arrangements the interface component may include a wireless transceiver which is configured to communicate with a machine controller or other device. In other exemplary arrangements the interface component may include a suitable interface connection to a wired communication connection which provides the control signals that are operative to deliver instructions and data to the shuttle. In some exemplary arrangements the power supply component and the interface component may be in connection with a single wired connection such as a USB connection which is suitable for delivering both electrical power and data and instructions to the shuttle circuitry. Of course it should be understood that these arrangements are exemplary and in other arrangements other approaches may be used.

It should be understood that in exemplary arrangements the UC shuttles 52 may include similar components to the exemplary LC shuttle described. However it should be understood that the UC shuttles may include a container engagement fixture instead of the container engagement platform of the LC shuttles. Further, it should be appreciated that in some arrangements only one of either the LC shuttles or UC shuttles will include a rotatable drive such as the exemplary drive 88 that may be operable to rotate the container. As can be appreciated, in many exemplary arrangements only one type of shuttle may include a drive that is operable to selectively rotate containers. Of course it should be understood that these arrangements are exemplary and in some arrangements the LC conveyor and UC conveyor may utilize different operating principles and have different types of shuttles movable thereon.

Figure 23:
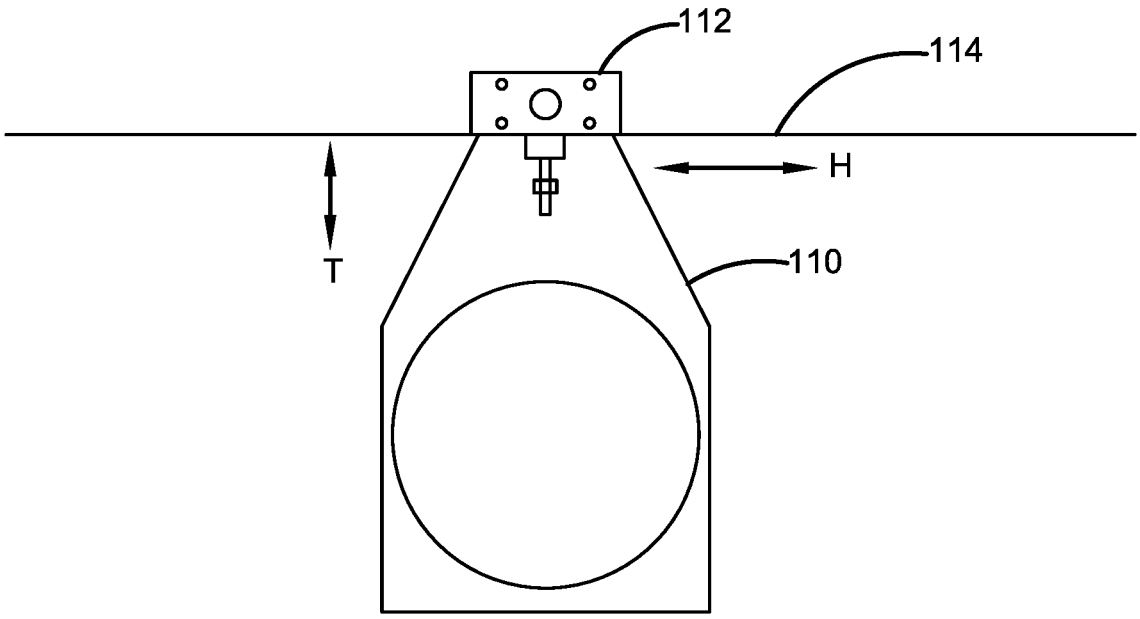
FIG. 23 is a top schematic view of an exemplary movable applicator mount.

The exemplary machine 10 further includes at least one applicator 108. The at least one applicator of the exemplary arrangement is positioned intermediate of the LC inlet end and the LC outlet end and adjacent to the UC track and the LC track. In the exemplary arrangement the applicator 108 is in operatively supported connection with a movable applicator mount 110. In the exemplary arrangement the movable applicator mount is in operative connection with the frame 12 of the machine. In some exemplary arrangements the applicator mount is in operative connection with at least one releasable clamp 112 which is selectively engageable in fixed engagement with horizontally extending struts 114 or other elements of the frame. In exemplary arrangements the applicator mount 110 is movably positionable horizontally along the direction of Arrow H in FIG. 23. As later discussed Arrow H corresponds to a direction along which containers move as they travel from the LC inlet end to the LC outlet end along the LC labeling track portion. The exemplary applicator mount further enables selective movement of the applicator 108 in a direction transverse to the horizontal direction as represented by Arrow T in FIG. 23. This enables the applicator to be positioned at the desired location both along the path of travel of the containers in the machine as well as at the desired transverse location from the centerline of the containers as may be desirable based on the cross-sectional diameter of the containers subject to being marked through operation of the machine. In exemplary arrangements suitable adjusting screws, gear racks, motors, hydraulic or pneumatic actuators, servos, solenoids or other movement mechanisms that operate in conjunction with suitable sensors and control circuitry may be included for selectively positioning the applicator mount and the associated actuator. Of course these approaches are exemplary and in other arrangements other approaches may be used.

In exemplary arrangements the applicator may include one or more of numerous different types of applicators that are selectively operative to provide markings to the containers that are processed by the machines. Such applicators may include for example pressure sensitive label (PSL) applicators which are capable of dispensing and applying self adhesive labels to containers. In such devices self adhesive labels are provided on a support film in the form of a continuous web wrapped on rolls or folded in a supply box. The exemplary PSL labeling devices may include an auto splicing unit to allow for a continuous label supply even as the end of a roll or other supply of labels is reached. Alternatively or in addition dual labeling device systems may be installed so that when one device reaches the end of its label supply another device automatically commences operation so there is no need to stop or decrease the speed of containers moving through the machine. Exemplary PSL labeling devices may include additional types of printers or markers as well as integrated sensing devices to control the applicator to apply the labels to a container.

Other types of applicators used in exemplary machines may include a cold glue label applicator. Exemplary applicators of this type are operative to dispense and apply paper or plastic patch labels to a container. In exemplary arrangements the labels are supplied individually cut. The labels are loaded in a magazine dispenser. The applicator picks a label from the magazine, applies cold glue to the label and causes the label to be delivered by the applicator into operative engagement with the container.

Another type of applicator used in exemplary machines may include a cut and stack hot melt label applicator. Such applicators include a mechanism that is able to dispense and apply paper or plastic patch or wrap around labels to a container. In exemplary arrangements the labels are supplied individually cut and are loaded in a magazine. A hot melt adhesive is applied to each respective container and label. Labels are transferred individually by the applicator to engage with a container and the hot melt adhesive previously applied. In some exemplary arrangements the hot melt adhesive is applied to the container only at the leading edge and to the trailing edge of the label which is wrapped about at least a portion of the circumference of the container.

Other exemplary applicators may include a roll fed hot melt labeling applicator. Such applicators are capable dispensing and applying plastic patch or wrap around labels to a container. In exemplary arrangements the labels are supplied on rolls. The applicator is operative to unwind the rolls and take each label individually from the continuous web of labels supplied on the roll. After cutting, the label is transferred through operation of the applicator through a roller that holds the label through a vacuum or other holding mechanism. While the label is being held the leading and trailing edges of the label are moved to contact a hot melt adhesive roller to provide adhesive to the label. In other arrangements the adhesive is pre-applied on the label roll. The applicator then pushes the label against the container while the container is rotated to wrap the label around the container circumference. In some exemplary arrangements such applicators are operative to apply adhesive only on the leading edge and the trailing edge of the label. In arrangements where the label extends fully around the container body the adhesive on the trailing edge of the label may operatively engage the trailing edge to the label adjacent to the leading edge.

Other exemplary applicators may include a sleeve labeling applicator. Exemplary sleeve labeling applicators operate to dispense and apply plastic sleeve labels to a container. Such labels are generally supplied in a sleeve form on rolls. The applicator is operative to open the sleeve and cut the sleeve to the correct length. The applicator then dispenses and moves the cut sleeve to surround the cylindrical portion of the container. Once the sleeve is in surrounding relation of the container, the sleeve may be heated or otherwise caused to shrink so as to adhere to the outer cylindrical shape of the container.

Other exemplary applicators may include direct printing applicators. Such direct printing applicators may operate to decorate a container by directly printing decorative features or other indicia on the external surface of the container. Such printing applicators may include for example, digital or analog printing devices. Other printing applicators may include inkjet printers, laser printers, stamping printers, roller printers or other types of printers that are usable to print indicia on an external surface of the container.

Of course it should be understood that these types of applicators are exemplary and in other arrangements other types of applicators may be used.

The exemplary machine further includes a container in feed conveyor 116 which receives incoming containers 118. Incoming containers are received by a feeder 120. In some arrangements the feeder includes a pair of horizontally disposed belt flights 122 that hold and move the containers in single file alignment. In other exemplary arrangements the feeder 120 comprises an in-feed spacing screw. The in-feed screw is operative to receive and move the incoming containers 118 in a single file arrangement and separated at a desired spacing. In other arrangements other types of feeders may be used. Each feeder is selectively operative to receive containers and deliver the containers in a controlled manner one at a time from the feeder.

At least one incoming container sensor 123 is positioned to sense an incoming container in the feeder 120 in adjacent relation with the LC inlet end 22 and the UC inlet end 34. Such a container sensor may comprise an optical, inductance, contact, or other suitable sensor type. The feeder is operative to selectively move containers in engagement with the feeder individually in a first direction indicated by Arrow D. In an exemplary arrangement at least one feature sensor 124 such as a camera or other image sensor is operative to sense at least one feature of an adjacent container. As later discussed, the at least one feature sensor is used for detecting at least one mark or feature of the container that is usable for purposes of selectively angularly or otherwise positioning the container for the application of markings thereto by the applicator 108.

In the exemplary arrangement a container outlet conveyor 128 operates to carry containers 130 that have been marked by the applicator 108 away from the LC and UC tracks and out of the machine. In the exemplary arrangement the outlet conveyor 128 may include a pair of horizontally spaced belts, feed screws or other suitable mechanisms for engaging the containers so that they are held upright and move uniformly horizontally away from the LC and UC tracks as they are disengaged by the shuttles. In exemplary arrangements the at least one optical sensor 126 is positioned to sense the markings on the container after the container has been marked by the applicator. In exemplary arrangements the at least one optical sensor 126 may include a camera or other sensor usable to detect optical characteristics of markings that have been applied to containers. The exemplary at least one optical sensor 126 is usable to determine characteristics of markings that are indicative of whether the markings have been properly or improperly applied to each container. The exemplary arrangement further includes a diverter 132. The exemplary diverter is operative to direct containers that have been determined not to have had the markings properly applied, onto a divert conveyor 134 or other similar collector which can be used to segregate the containers to which markings were not properly applied from other containers that have been properly marked. Of course this approach is exemplary and in other arrangements other approaches may be used.

Figure 5:
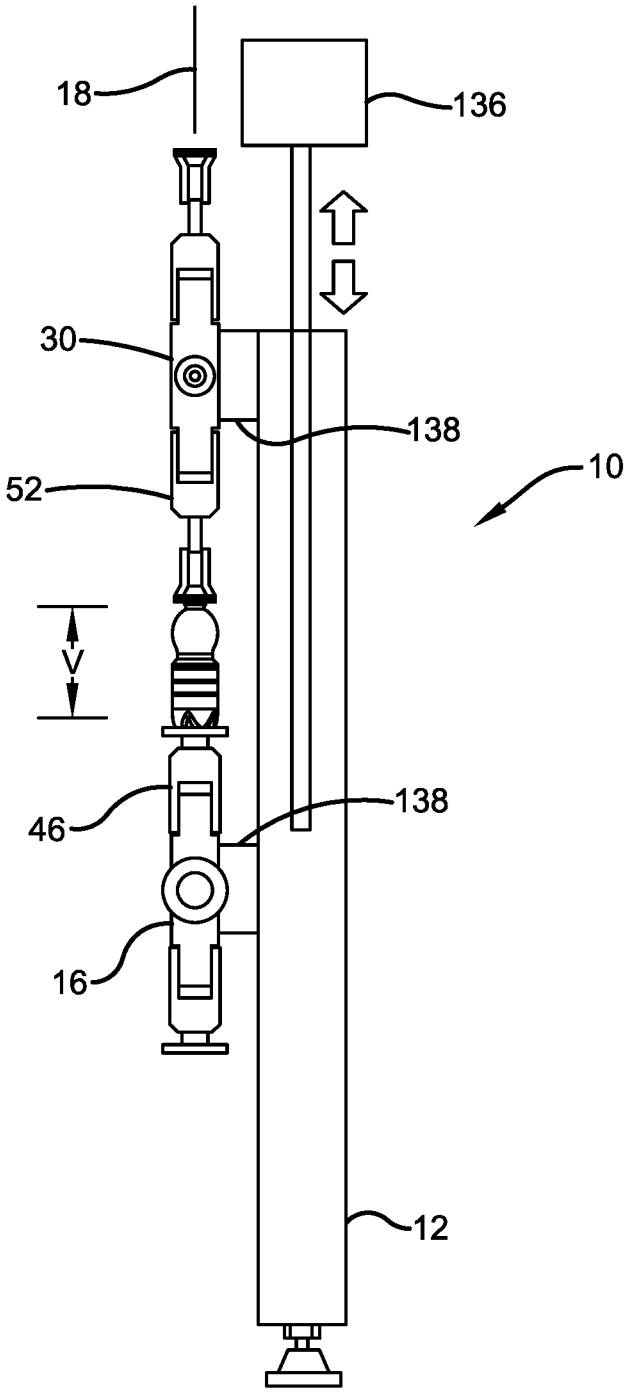
FIG. 5 is a schematic view representing a portion of the machine frame and a jack usable to selectively change a vertical distance between the exemplary upper and lower conveyor tracks.

In an exemplary arrangement the LC track and the UC track are movably mounted in operative connection with the frame 12 as represented in FIG. 5. At least one jack 136 is in operative connection with at least one of the LC track and the UC track so as to selectively change a vertical distance V between the LC shuttles 46 and the UC shuttles 52. In exemplary arrangements the jack may include one or more rotatable jack screws, hydraulic actuators, pneumatic actuators, gear racks, motors or other suitable mechanical devices that can be used for selectively varying the vertical distance between struts 138 that operatively connect the LC track and UC track to the frame 12. In some exemplary arrangements the jack may be manually actuatable to set the vertical distance. In other exemplary arrangements the jack may be operated responsive to electrical signals which are provided responsive to either manual inputs or automatically in response to suitable circuitry and position sensors. This feature of the exemplary arrangement that varies the vertical distance facilitates the setup of the machine to handle containers of differing vertical dimensions. Of course it should be understood that this configuration is exemplary and in other arrangements other approaches may be used.

Figure 6:
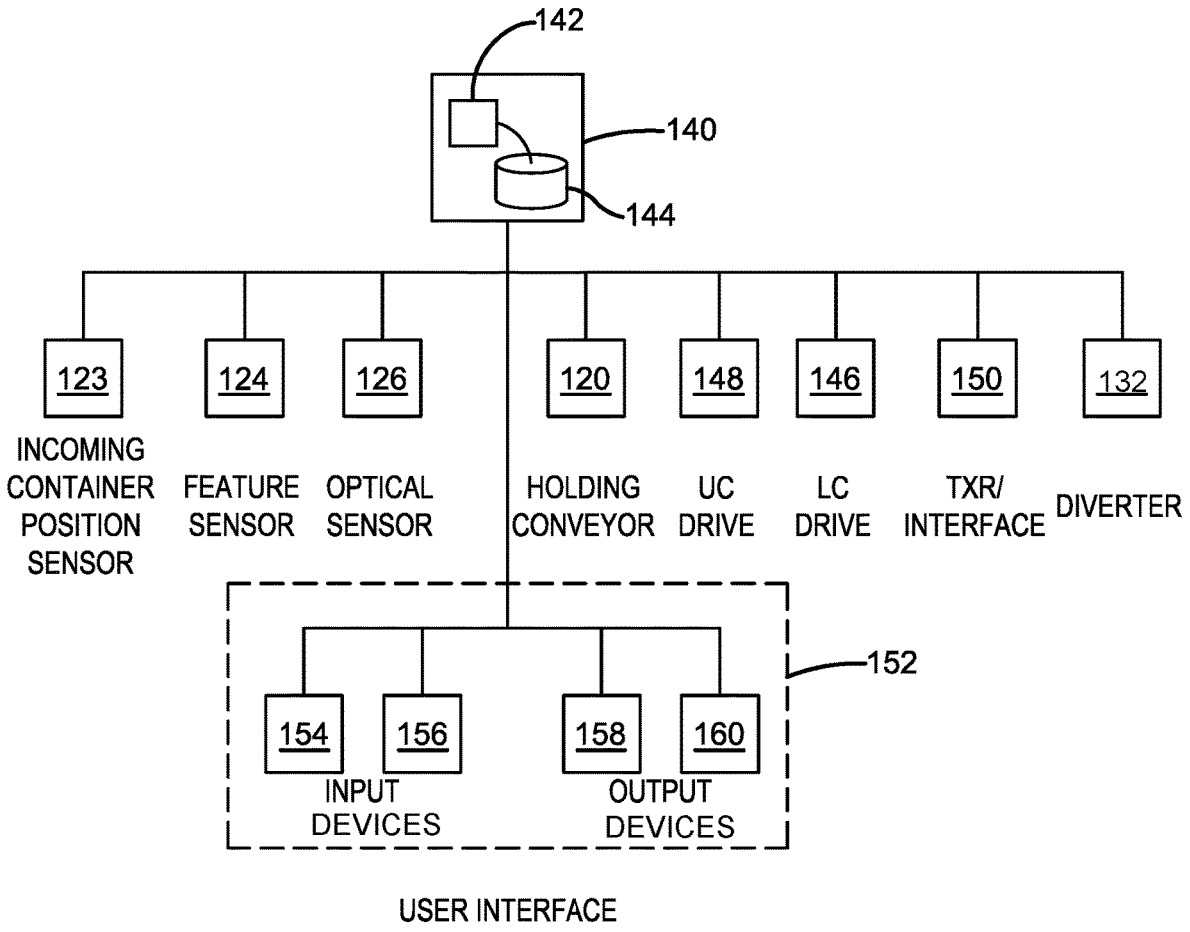
FIG. 6 is a schematic view of exemplary circuitry used in connection with controlling operation of an exemplary machine.

Exemplary circuitry of the machine 10 is schematically represented in FIG. 6. The exemplary machine includes a machine controller 140. The exemplary machine controller 140 includes at least one processor 142 that is in operative connection with at least one data store 144. The at least one processor and at least one data store may have structures like those previously discussed in connection with the shuttle controller 98. The exemplary data store is operative to hold data and circuit executable instructions which are operative to control operation of the machine in a manner like that later discussed.

In the exemplary arrangement the machine controller 140 is in operative connection with the at least one incoming container position sensor 123 and that the holding conveyor 120. The controller 140 is also in operative connection with the at least one feature sensor 124 and the at least one optical sensor 126. The controller is further in operative connection with at least one LC drive interface 146 which in the exemplary arrangement is operative to communicate signals to control movement of the LC shuttles including the shuttle drives 92 and rotating drives 88 thereon. The controller is further in operative connection with at least one UC drive interface 148. The exemplary UC drive interface is operative to communicate signals to control the UC shuttles including the shuttle drives and container rotating drives thereon, if applicable.

The exemplary machine controller 140 is also in operative connection with an interface 150. In some exemplary arrangements the interface 150 comprises a wireless transceiver that is operative to communicate with the wireless transceivers in the LC shuttles and/or UC shuttles. A wireless transceiver may be utilized in arrangements where shuttle operation is controlled through wireless communication between the machine controller 140 and each of the shuttles. In other exemplary arrangements the interface 150 may comprise a wired connected interface such as those later discussed that may be operative to communicate signals with shuttles for purposes of controlling the operation thereof. Further in exemplary arrangements the machine controller is in operative connection with the diverter 132. The diverter is operative to segregate containers that are determined through operation of the machine controller not to have the markings properly applied thereto.

The exemplary controller is also in operative connection with a user interface 152. The exemplary user interface is operative by a machine user to control the operation of the machine as well as to provide the necessary inputs for purposes of configuring the machine to handle different sized containers. The exemplary user interface 152 includes exemplary input devices 154, 156 and output devices 158, 160. The exemplary output devices 158, 160 may include devices such as indicators, dials, displays, warning lights, audible indicators or other devices that output signals and/or information. The exemplary input devices may include buttons, knobs, a touchscreen input overlay, a pointing device, a microphone or other devices that may receive inputs from the user. Of course it should be understood that these input and output devices are merely exemplary of numerous different types of such devices that may be used. Such input and output devices may be utilized by a user to provide the necessary inputs to the controller 142 to enable machine set up and operation. Such input and output devices may also be utilized by the user to monitor and control operation of the machine.

It should be understood that the exemplary machine controller may also be in operative connection with other devices that are associated with the machine. This may include for example the applicator or applicators that are utilized for purposes of applying markings to containers. Such additional devices controlled and/or monitored through operation of the controller 140 may further include the in feed conveyor 116 and the outlet conveyor 128. In addition in some exemplary arrangements the controller may supply the data which is used to produce the indicia that is applied to containers by an applicator. This may include data such as time and date data that is used to produce the indicia that is applied to containers, for example. Numerous different types of control circuitry may be in operative connection with machines having different arrangements which are operative to provide markings to various types of containers.

Figure 4:
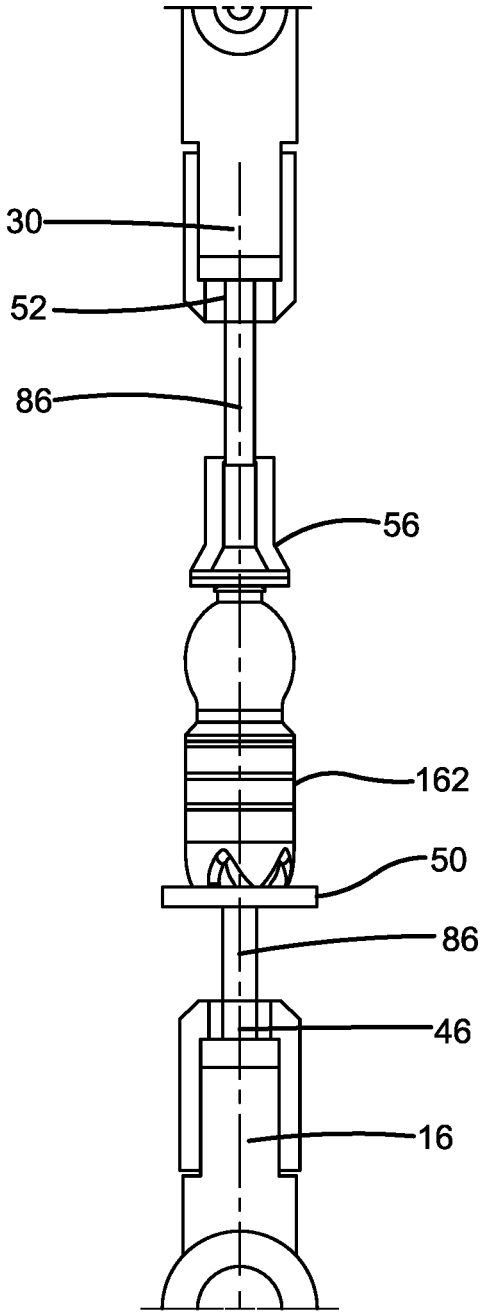
FIG. 4 is a schematic view of an exemplary container held in a shuttle engaged position.

In operation of the exemplary machine 10 the at least one incoming container position sensor 123 is operative to detect a container in the feeder 120 proximate to the LC inlet end 22 and the UC inlet end 34. The machine controller 140 is operative in accordance with the circuit executable instructions in the data store 144, to communicate signals with a respective LC shuttle 46 to cause the shuttle to move into a receiving position on the LC track. In the receiving position the container engagement platform is adjacent to the outlet of the feeder 120. The machine controller 140 is further operative to communicate with a UC shuttle 52 to cause the shuttle to move into a position adjacent to the feeder. The exemplary machine controller 140 then operates the feeder 120 to deliver a container therefrom as the respective LC and UC shuttles are operated to move responsive to the controller and to engage the container vertically between the respective LC shuttle and UC shuttle. In some exemplary arrangements a portion of the platform of the LC shuttle and/or a portion of the UC shuttle may be controlled to move vertically to achieve container engagement. This container engaged position of a container 162 is represented in FIG. 4. In this container engaged position the container is engaged between the container engagement fixture 56 of the UC shuttle 52 and the container engagement platform 50 of the LC shuttle 46.

Figure 9:
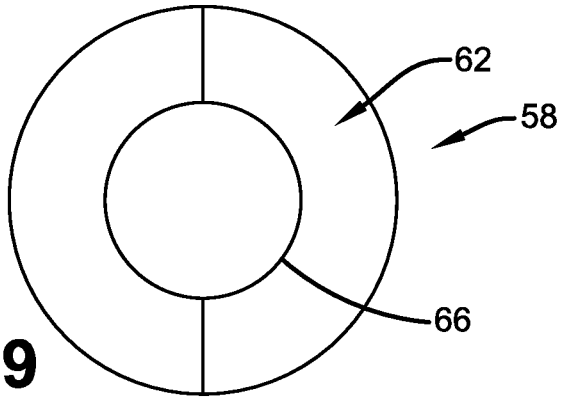
FIGS. 8 and 9 are side and top views respectively of an exemplary container including features that can be sensed by the at least one feature sensor for rotatably positioning the container.

In the operation of the exemplary machine the machine controller 140 operates in accordance with its circuit executable instructions to move the LC shuttle and UC shuttle in coordinated relation in the first direction D to move the container 162 in the container engaged position along the LC and UC labeling track portions. As the container is moved in the container engaged position, the exemplary at least one feature sensor 124 is operative to sense at least one feature of the container 162. In some exemplary arrangements the at least one feature sensor is operative to sense a registration mark such as mark 164 shown in FIG. 9. In some exemplary arrangements the registration mark may be a mark that is molded into the container at the time of manufacture. In other exemplary arrangements the feature sensor may be operative to sense an applied registration mark 166. Registration mark 166 may comprise a mark that is applied to the container subsequent to manufacture such as for example at the time of filling the container with material. In other exemplary arrangements the at least one feature sensor 124 may be operative to sense a parting line 168 or other mold line. The parting line 168 may constitute a mark that is produced during the manufacturer of the container in the area where mold pieces are separated to release the container from a mold. Such a parting line may be indicative of a particular angular location on the container. Such lines may also include circumferential or other mold form lines or features. Alternatively in other arrangements the at least one feature sensor may be operative to sense a closure piece such as a mark or other feature portion of cap 66.

In exemplary arrangements each of the features sensed through operation of the at least one feature sensor 124 constitute a mark indicative of a particular position such as an angular orientation and/or a vertical position of the container. The machine controller 140 is operative responsive to the at least one feature sensor 124 sensing a location of the mark to make a determination as to the needed rotational movement or other movement of the container in order to place the container in the desired angular orientation or other position so that the applicator 108 may apply the markings to the container an appropriate manner.

In the exemplary arrangement the controller 140 may operate in accordance with the associated circuit executable instructions in the data store 144 to communicate signals with the drive 88 of the respective LC shuttle to cause rotation or other movement of the container engagement platform 50 and/or container engagement fixture 56. The signals from the exemplary machine controller may be operative to cause the container engagement platform 50 to rotate the container in the container engaged position so as to bring the registration mark or other mark on the container into the desired angular registration position. In other exemplary arrangements the exemplary shuttle, may alternatively or additionally be controllable to cause other container movement such as selectively controlled vertical movement of the container. In some exemplary arrangements the movement of the container engagement platform 50 and/or engagement fixture 56 may be monitored through operation of the at least one feature sensor or other sensor to determine when the container is in the desired orientation. Of course as can be appreciated, in the exemplary arrangement where the LC shuttle 46 includes the drive 88 which is operative to rotate or otherwise move the container engagement platform 50, the container engagement fixture 56 on the UC shuttle 52 is operative to rotate with the rotation or other movement of the upper portion of the container without substantial resistance. Thus the machine controller 140 is enabled to orient the container in the desired orientation for application of the markings by the applicator 108.

Figure 11:
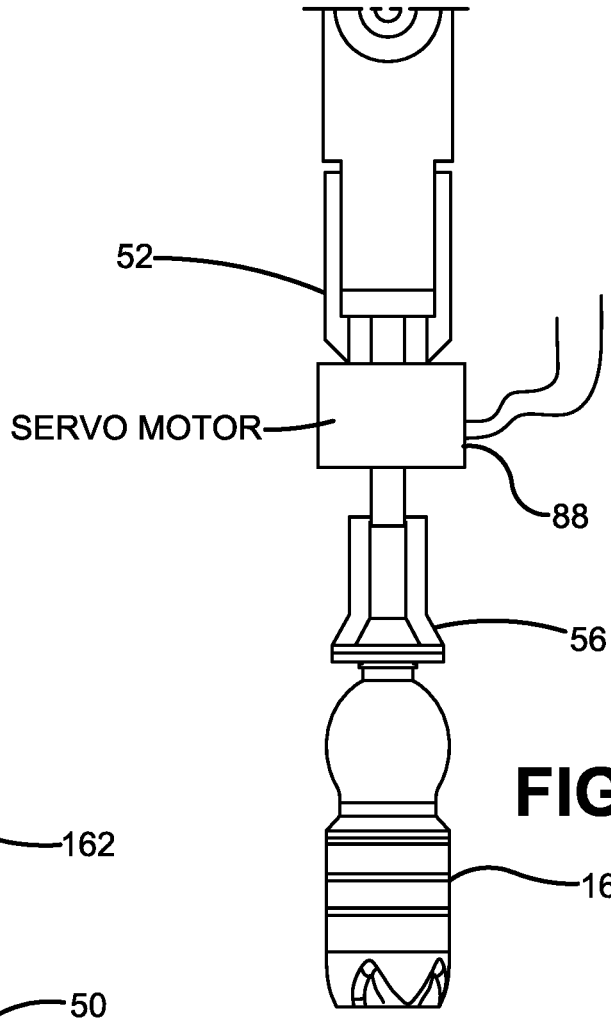
FIGS. 10 and 11 are representative of motor drive arrangements that can be utilized for selectively rotating a container in the container engaged position vertically between LC and UC shuttles.
Figure 10:
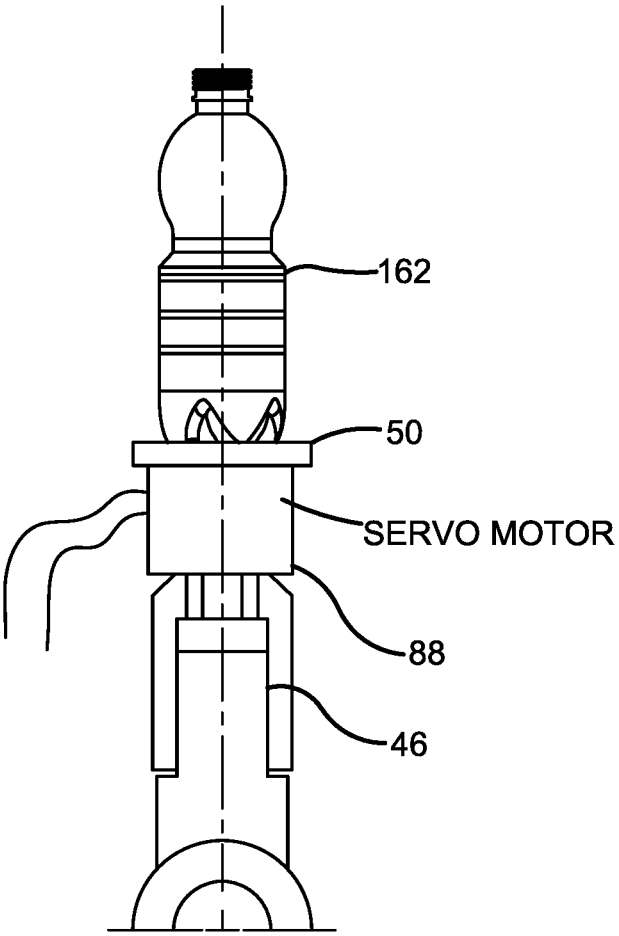

Numerous different drives can be utilized in various machine arrangements for purposes of rotating or otherwise moving a container such as container 162 that is in the container engaged position, to the desired angular orientation. For example, FIG. 10 shows schematically a representation of the system previously described in which the drive for the container engagement platform 50 is in operative connection with the LC shuttle that is in engagement with the container 162. FIG. 11 shows the alternative arrangement in which the drive 88 comprises a motor in supported connection with a UC shuttle 52. In such an arrangement the drive 88 is operative to rotate the container 162 through engagement with the container engagement fixture 56.

Figure 13:
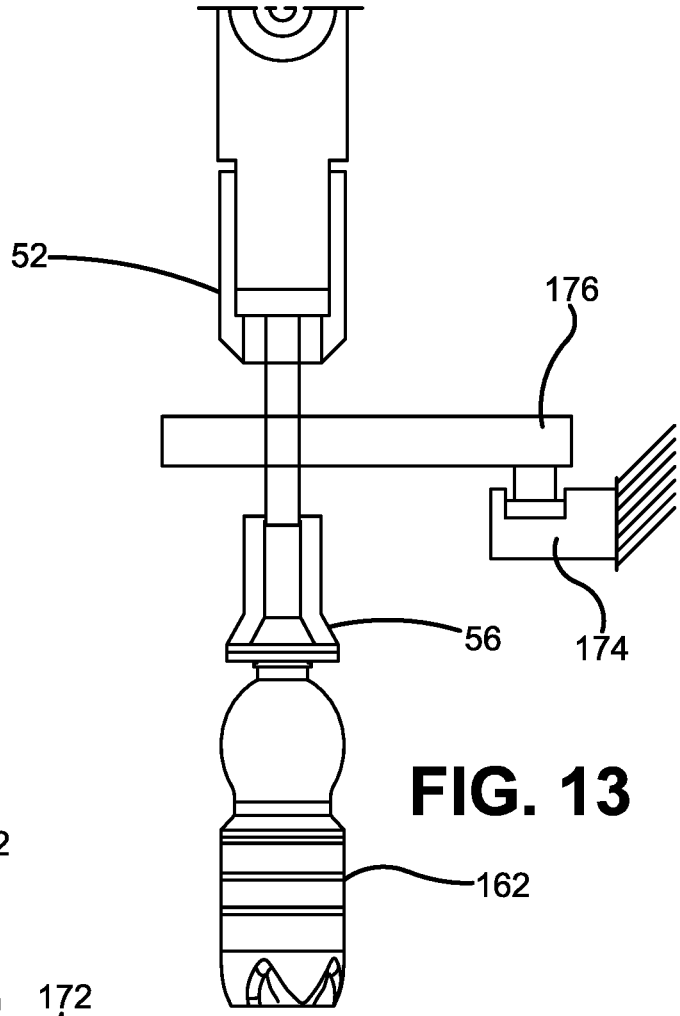
FIGS. 12 and 13 are representative of cam drive arrangements that can be utilized for selectively rotating a container in the container engaged position.
Figure 12:
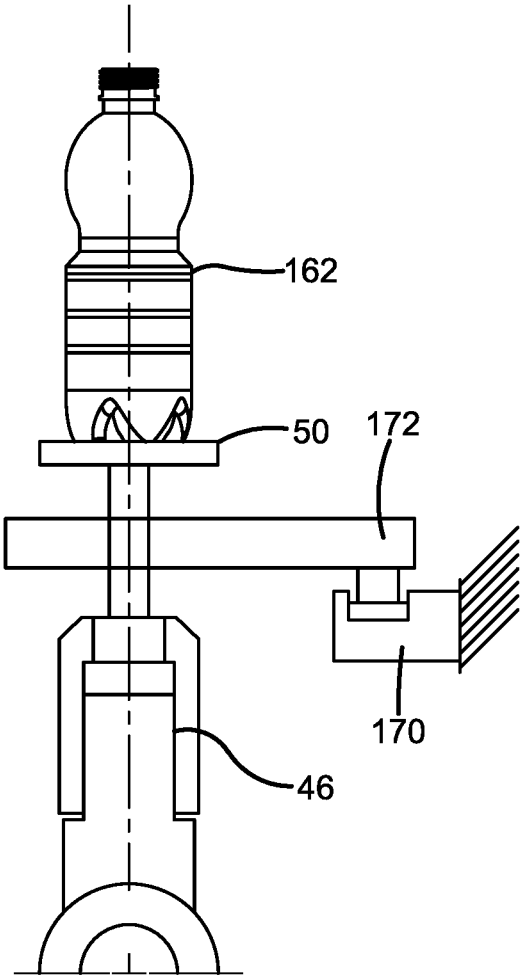

FIG. 12 shows an alternative drive arrangement in which a mechanical cam 170 which is in operatively fixed connection with the frame 12 of the machine is in engagement with a cam follower 172 which is in connection with the container engagement platform 50. In such an exemplary arrangement movement of the LC shuttle 46 is operative to cause movement of the cam follower 172 in engagement with the cam 170 so as to selectively rotate the container engagement platform 150. Alternatively as shown in FIG. 13 a UC shuttle 52 may be in operative connection with a cam 174 through a cam follower 176. In such an arrangement movement of the UC shuttle is operative to cause rotation of the container engagement fixture 56 responsive to relative movement of the cam and cam follower responsive to movement of the shuttle. Of course it should be understood that the degree of permitted rotational movement responsive to cam engagement may be selectively controlled through operation of clutches or other releasible connecting devices responsive to operation of the machine controller 140 so as to provide only the needed amount of container rotation to place the container in the desired angular orientation.

Figure 15:
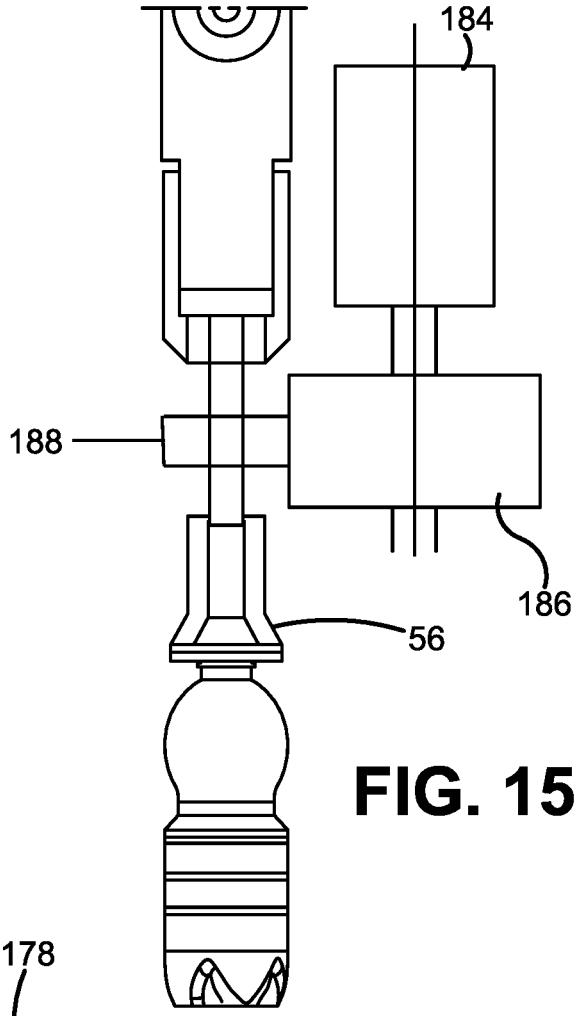
FIGS. 14 and 15 are representative of belt or roller drive arrangements that can be utilized for selectively rotating a container in the container engaged position.
Figure 14:
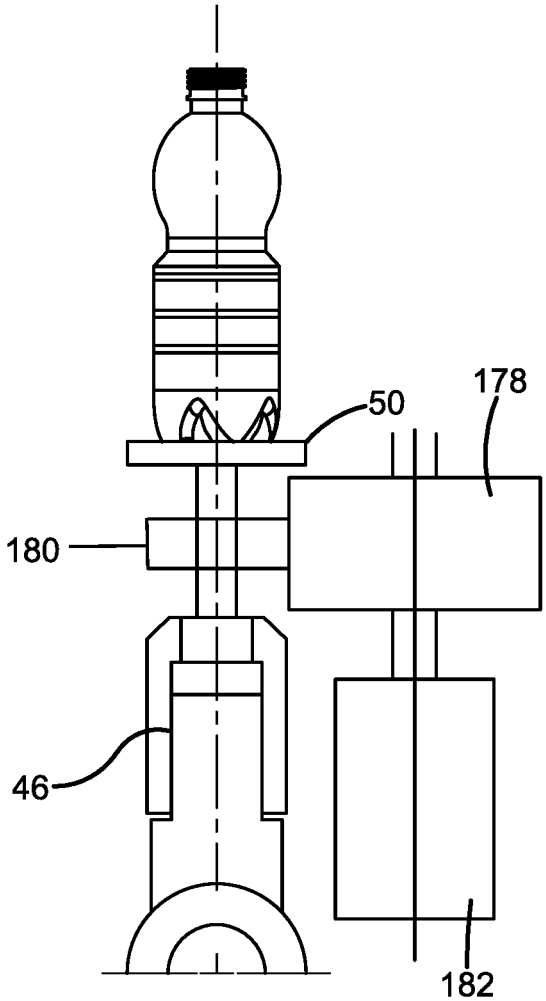

FIG. 14 shows yet a further alternative drive arrangement for selectively rotating a container in the container engaged position between an LC shuttle and UC shuttle. In the arrangement shown, coordinated rotating members such as rollers or pulleys 180 are in operative connection. In some arrangements where pulleys are used the pulleys may be in operative connection through an intermediate flat or toothed belt 178 or similar connector. The belt 178 is moved responsive to a drive motor 182. In exemplary arrangements the drive motor is controlled responsive to the machine controller 140 so as to rotate the container engagement platform 50 and the container supported thereon to the desired angular orientation. FIG. 15 shows an alternative arrangement of the drive which is operative to selectively rotate a container to a desired angular orientation. In this exemplary arrangement a drive motor 184 which is controlled responsive to the machine controller, is operative to rotate operatively connected rollers or pulleys 188 and a flat or toothed belt 186. The connected rollers or pulleys and belt are operative to rotate the container through rotation of the container engagement fixture 56.

Figure 17:
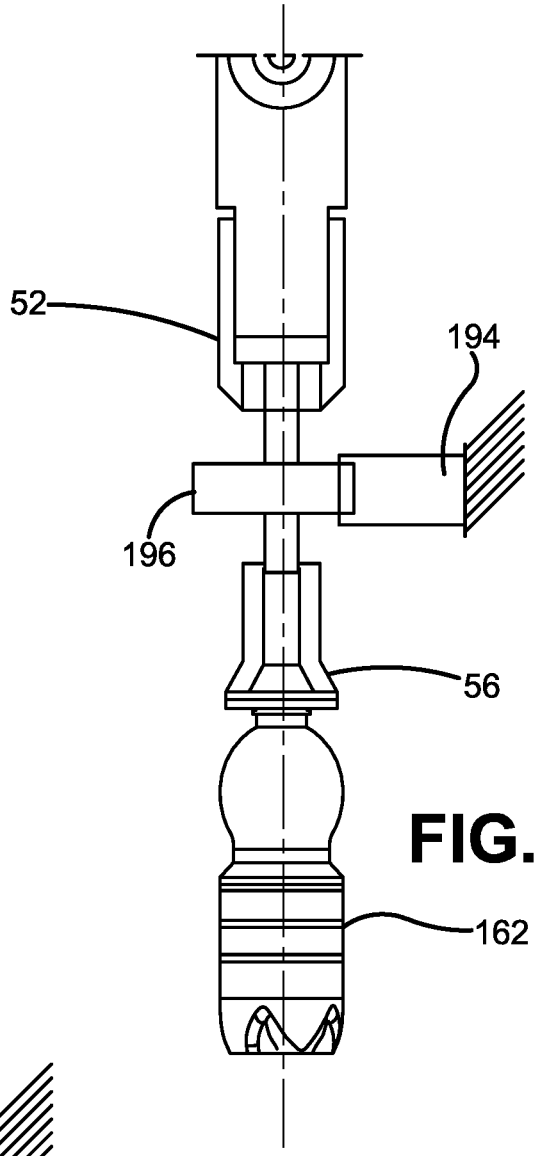
FIGS. 16 and 17 are representative rack and pinion drive arrangements that can be utilized for selectively rotating a container in the container engaged position.
Figure 16:
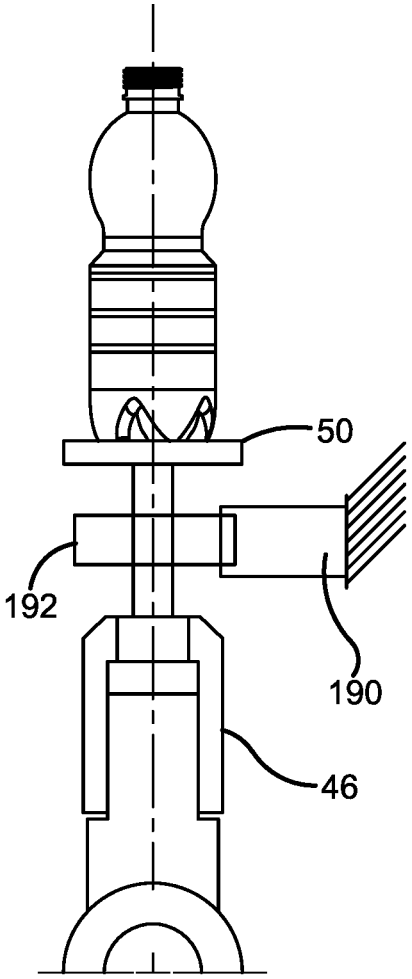

FIG. 16 shows yet a further alternative of a drive that is usable in some exemplary arrangements to selectively rotate a container to desired angular orientation. In this exemplary arrangement the drive includes a gear rack 190 that is in operatively fixed connection with the frame 12 of the machine. The gear rack is in operative engagement with the pinion gear 192 that causes rotation of the container engagement platform 50 responsive to movement of the LC shuttle 46 along the first direction. The machine controller is operative to control the movement of the LC shuttle so as to angularly rotate the container to the desired angular position. Intermediate clutches or other similar mechanisms may be utilized to operatively engage and disengage the gear rack from the container engagement platform. The mechanism may be operative to disengage once the movement of the LC shuttle has resulted in movement of the container to the desired angular position. Similarly FIG. 17 shows a drive that includes a gear rack 194 that is in operative connection with the pinion gear 196. Movement of a UC shuttle 52 is operative to rotate the container engagement fixture 56 in operative connection with the container 162. The container 162 may be rotated responsive to movement of the UC shuttle in operative engagement with the gear rack to the desired angular position.

Of course it should be understood that these drives that may be utilized to provide the rotation of the container to the desired angular orientation or other suitable position for application of the markings by the applicator 108 are exemplary, and in other arrangements other devices such as motors, linear actuators, servos, solenoids or other structures for selectively moving containers rotationally, vertically and in other directions may be used to suitably position the containers.

In operation of the exemplary machine once the container is moved in the first direction to be in operative connection with the applicator, the applicator operates to apply the markings to the container 162. This may be done through operation of the applicator and appropriate sensors and control circuitry associated therewith. Alternatively in other arrangements the applicator 108 may be controlled by the machine controller 140 in accordance with the circuit executable instructions in the at least one data store 142. As previously discussed, with certain applicators it is necessary to rotate the container while in operative connection with the applicator to apply the markings such as a label around the circumference of the cylindrical cross-section of the container. This may be done in exemplary arrangements through operation of the controller operating a drive such as drive 88 which is housed within a respective LC shuttle or UC shuttle. Likewise rotational movement of the container in operative connection with an applicator may be utilized for purposes of moving the container to apply the markings such as indicia by a stationary inkjet printer or other type printing device. Of course it should be understood that these approaches are exemplary and in other arrangements other approaches may be used.

In the exemplary arrangement once the markings have been applied by the applicator 108, the container 162 is moved in the container engaged position through the coordinated movement of the LC and UC shuttles in the first direction toward the LC outlet end 24. As the UC shuttle in engagement with the container moves along the first direction and reaches the UC outlet end 36, at least a portion of the exemplary UC shuttle moves vertically upward and away from the upper portion of the container. This causes the UC shuttle to disengage from the container. Likewise, as the LC shuttle reaches the LC shuttle outlet end the container moves off the container engagement platform and onto engagement with the outlet conveyor 128. In the exemplary arrangements the machine controller 148 is operative to control the movement of the respective LC shuttle and UC shuttle and the outlet conveyor so as to assure that the container is properly released and placed so as to be in proper upright engagement with the outlet conveyor. Of course it should be understood that while in the described arrangements containers move in one direction along Arrow D, other arrangements may control the shuttles to move in both directions along Arrow D to have various processes performed.

In operation of the exemplary machine after the markings have been applied by the applicator 108, the markings that have been applied are sensed by the at least one optical sensor 126. The at least one optical sensor 126 is operative to sense optical characteristics of the markings that have been applied. For example in exemplary arrangements the at least one optical sensor may include a camera or other image capture devices or image sensors that are operative to capture data that is usable to determine if the markings have been placed in the appropriate positions on the container, are in the correct orientation, and/or are otherwise properly applied. Of course in other exemplary arrangements other types of sensors such as contact sensors, electric sensors, magnetic sensors, laser sensors, reflective sensors or other types of sensors which may detect aspects of the applied markings may be used.

In the exemplary arrangement the at least one data store includes quality data. The exemplary quality data corresponds to aspects of at least one of proper application of marking to a container or improper application of marking to a container. In exemplary arrangements the quality data may correspond to image data that is indicative of properties or features of labels or other markings that can be detected by the at least one optical or other sensor and utilized to identify at least one of proper or improper marking. In the exemplary arrangement the machine controller 140 is operative responsive to the quality data and the optical characteristics of the applied markings sensed by the at least one optical sensor, to make a determination concerning whether there is improper marking on the container. In some exemplary arrangements the determination may be based on detection of characteristics that are indicative of improper marking, while in other arrangements the determination may be based on the sensed characteristics not passing certain quality standards which are indicative of proper marking. Of course as can be appreciated numerous different approaches may be taken to identify conditions corresponding to improper marking depending on the particular marking type that is applied, the sensor types and in the nature of the particular container.

Responsive at least in part to the determination that the container contains improper marking, the machine controller 140 is operative to generate at least one signal. The at least one signal is operative to cause the container with the improper marking to be segregated from the other containers which have been determined to include proper marking. In exemplary arrangements the at least one signal may be operative to cause the diverter 132 to cause the container with the improper marking to be directed to the divert conveyor 134. Of course this approach is exemplary and in other arrangements other approaches may be used.

Figure 19:
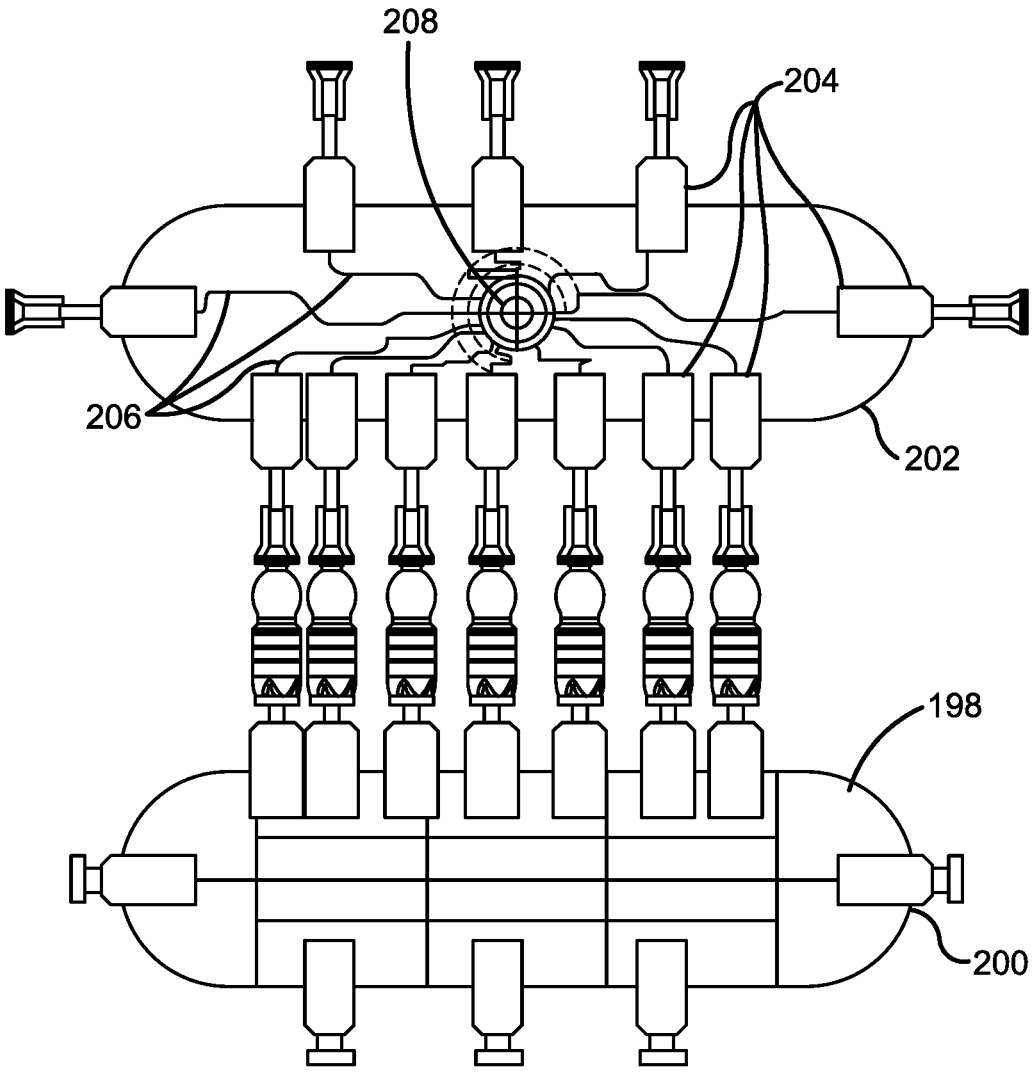
FIG. 19 is a schematic representation of an approach for providing electrical power and control signals to a plurality of UC shuttles.

Alternative machine arrangements may include other features which provide for effective operation of the machine. For example an alternative arrangement is shown in FIG. 19 which includes a LC 198 with LC shuttles 200 movable thereon. The alternative arrangement includes a UC 202 with UC shuttles 204 movable thereon. In this exemplary arrangement the UC shuttles 204 are operatively electrically connected to the at least one machine controller through respective cables 206. In the exemplary arrangement the cables are connected to a rotatable connector 208. In this exemplary arrangement each UC shuttle 204 is connected to the rotatable connector 208 by a single dedicated cable 206. As the UC shuttles 204 are moved by each respective shuttle drive responsive to operation of the machine controller, the rotatable connector 208 is operative to rotate so as to reduce the risk of entanglement of the cables. In some exemplary arrangements the rotatable connector may include a motor or other selectively rotatable drive controllable through operation of the controller to maintain the desired orientation of the cables 206. In other arrangements the rotatable connector may be freewheeling and the cables are connected through supports or other connectors which cause the rotation of the connector.

In the exemplary arrangement the cables 206 may be operative to provide electrical power to each respective shuttle, communicate control signals to components of the shuttle, or both. In the exemplary arrangement shown in FIG. 19 the LC 198 and LC shuttles 200 may be of one of the types previously discussed. The LC shuttles 200 may operate responsive to wireless or other signals without a cable connection to provide a power source or control signals to each shuttle. Such arrangement may be desirable for certain types of machines and marking operations.

Figure 20:
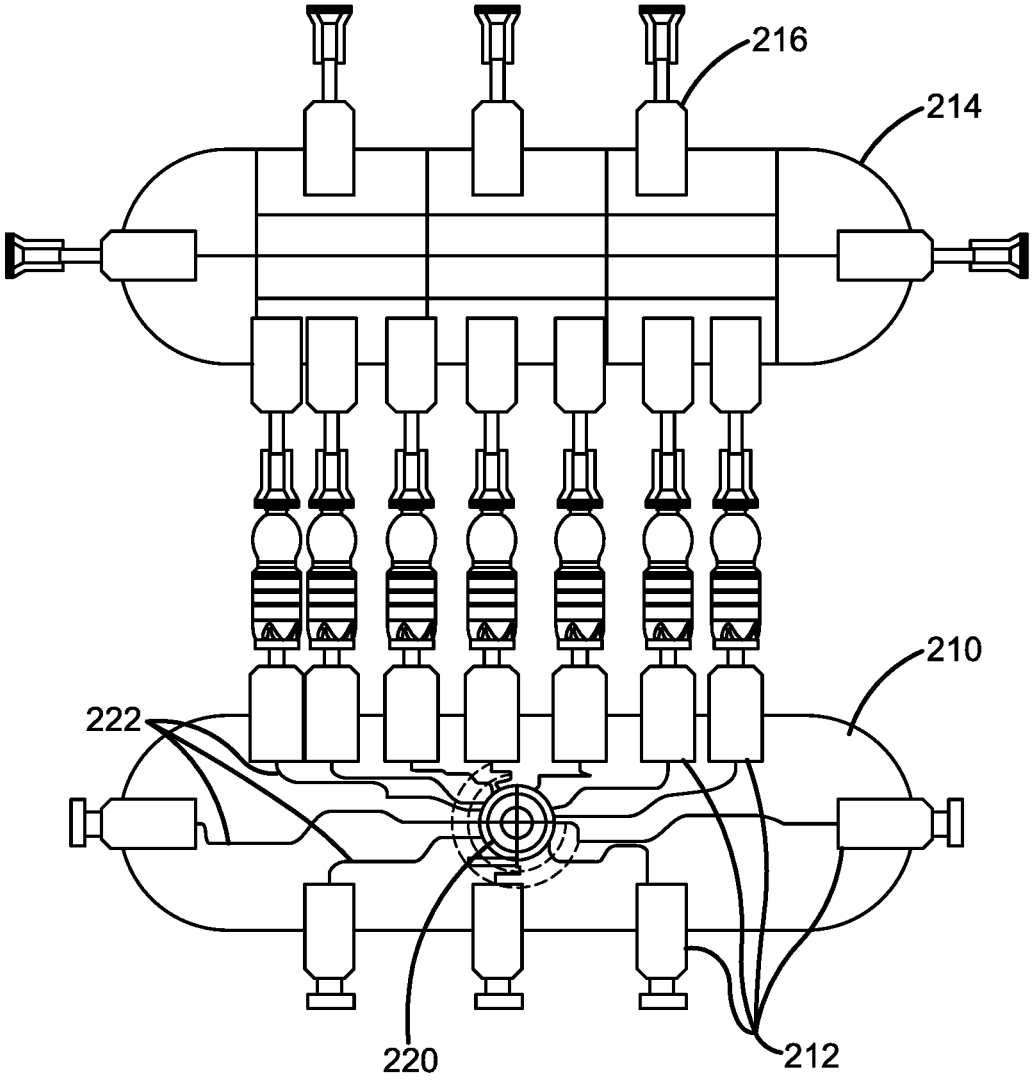
FIG. 20 is a schematic representation of an approach for providing electrical power and control signals to a plurality of LC shuttles.

FIG. 20 shows an alternative arrangement which includes an LC 210 with LC shuttles 212 movable thereon. A UC 214 includes UC shuttles 216 that are movable thereon. In this exemplary arrangement a rotatable connector 220 is in operative connection with cables 222. A respective cable 222 electrically connects the rotatable connector 220 with each respective LC shuttle 212. As in the previously discussed arrangement, the LC shuttles 212 may be operative to receive electrical power and/or control communications through the respective cables 222. The UC shuttles 216 may be operative to move in a controlled manner in one of the ways previously discussed. Of course it should be understood that these approaches are exemplary and in other arrangements both the LC and the UC may use cable connections to supply power and/or control signals to some or all of the respective shuttles.

Further it should be understood that other exemplary arrangements may include other types of shuttle connections. For example in some arrangements shuttles may be connected in a serial arrangement with cables that extend between shuttles that are immediately adjacent to one another on a respective track. In other example arrangements signals may be communicated with shuttles through radio, magnetic or inductance signals that may be multiplexed or otherwise simultaneously presented in signals that cause other actions such as shuttle movement. Of course it should be understood that these approaches are exemplary and in other arrangements other approaches may be used.

Figure 21:
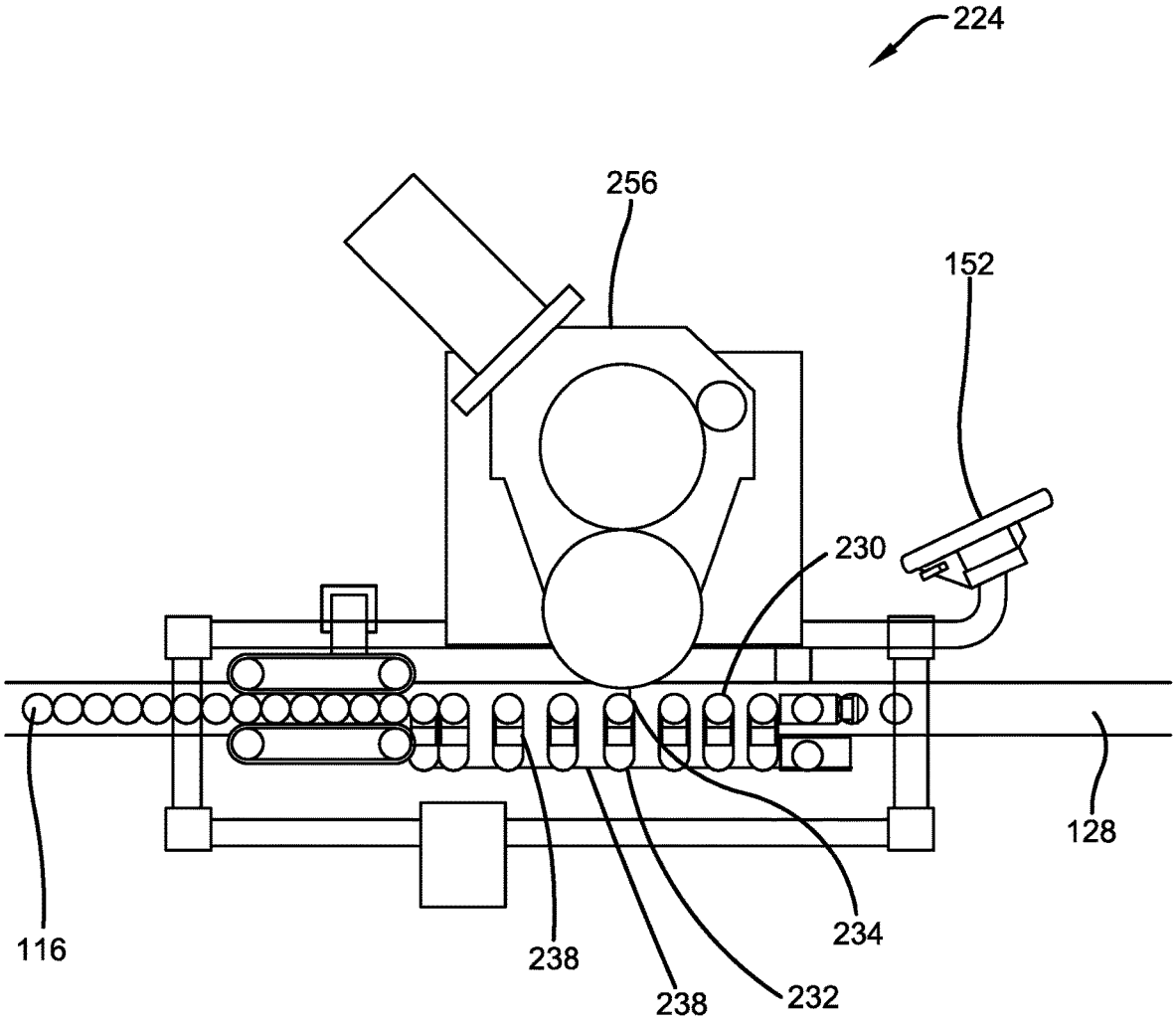
FIG. 21 is a schematic representation of a top view of an alternative arrangement of a machine that includes a respective upper conveyor and a lower conveyor with a respective horizontally adjacent shuttle supporting track.
Figure 22:
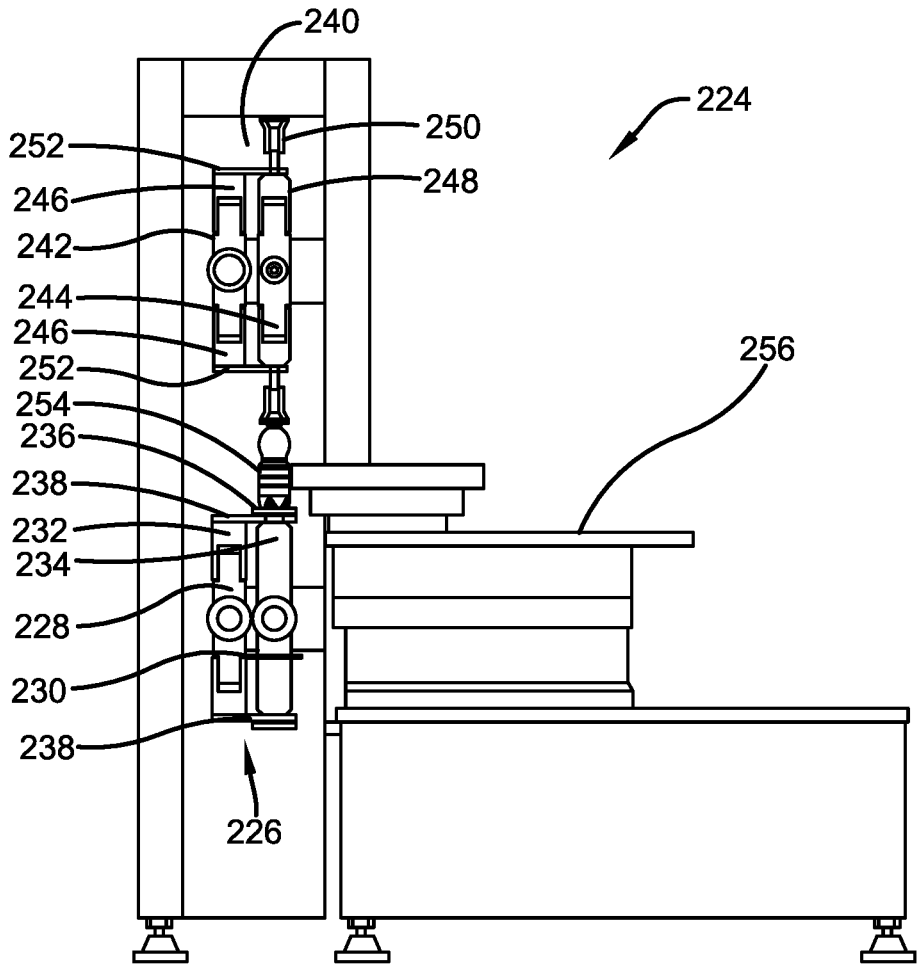
FIG. 22 is a side view of the machine shown in FIG. 21.

FIGS. 21 and 22 show a further alternative arrangement of a labeling machine 224. Machine 224 may have features similar to those of machines previously described except as otherwise indicated herein. In this exemplary arrangement the exemplary UC and LC each include a conveyor track that is comprised of two parallel side by side tracks. For example, machine 224 has an LC track 226 comprised of an LC drive track 228 and an LC driven track 230. The LC drive track 228 includes a plurality of LC drive track carriers 232 that are movable thereon. The LC drive track carriers 232 may be selectively individually movable in a manner like the shuttles of the previously described arrangements. The LC driven track 230 includes a plurality of movable driven LC shuttles 234 thereon. The driven LC shuttles 234 of an exemplary arrangement may have features similar to the previously described LC shuttles such as a rotatable container engagement platform 236 thereon that is selectively rotatably driven by a drive.

In the exemplary arrangement each of the LC drive track carriers 232 includes a releasable connector 238. The releasable connector 238 is operative to releasably engage a respective LC drive track carrier with the respective driven LC shuttle 234. In the exemplary arrangement the releasable connector 238 is operative to cause the respective driven LC shuttle 234 to be selectively moved about the LC driven track 230 responsive to movement of the LC drive track carrier engaged therewith. Further in some exemplary arrangements the respective releasable connector 238 may be in operative connection with an actuator or other mechanism that enables controlled engagement and disengagement with selected driven LC shuttles 234 responsive to operation of the actuator by the machine controller. In some arrangements LC shuttles may be selectively moved in both directions along the LC track. Thus in some exemplary arrangements a single LC drive track carrier 232 may be operative to selectively move different driven LC shuttles 234 through selective engagement and disengagement of the releasable connector 238. This may avoid the need for example, of having a respective LC drive track carrier for each driven LC shuttle of the LC.

In the exemplary arrangement of machine 224 a UC 240 similarly includes a UC drive track 242 and a UC driven track 244. The UC drive track includes a plurality of UC drive track carriers 246 that are selectively movable thereon. The UC driven track 244 includes a plurality of driven UC shuttles 248. In the exemplary arrangement shown, the driven UC shuttles 248 may include features of UC shuttles previously described including having a respective container engagement fixture 250. In the exemplary arrangement each UC drive track carrier 246 includes a releasable connector 252. The releasable connectors 252 may be operative in a manner similar to the releasable connectors 238 previously described to selectively engage and disengage a respective UC drive track carrier 246 and a selected driven UC shuttle 246. Thus in exemplary arrangements the machine controller may operate to engage containers 254 in a container engaged position between a respective driven LC shuttle and a respective driven UC shuttle to be in operative connection with an applicator 256 to apply markings thereto. Of course it should be understood that this arrangement is exemplary, and in other arrangements other approaches may be used.

Figure 24:
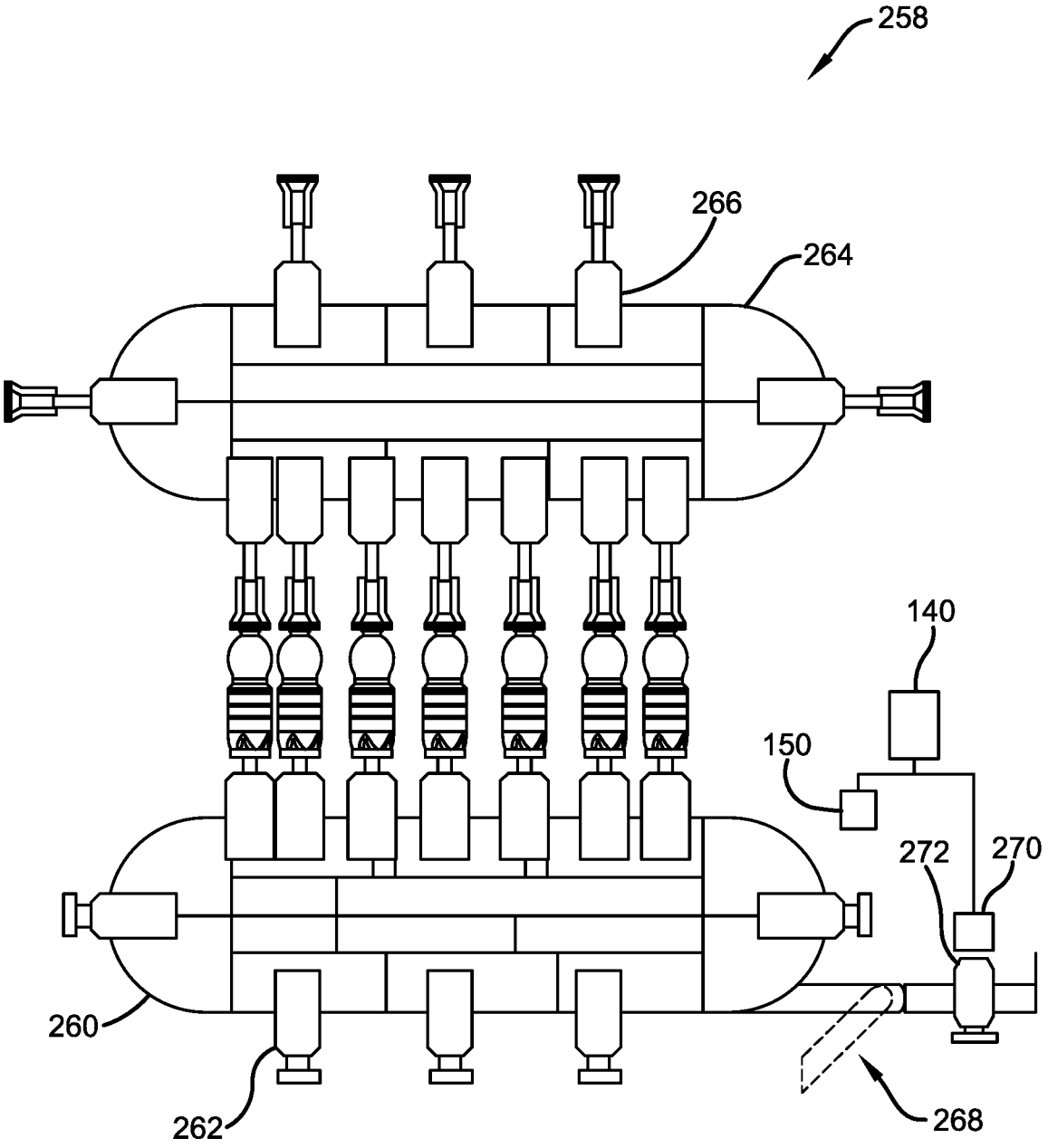
FIG. 24 is a front schematic view of an exemplary machine that includes battery powered LC shuttles and an LC track spur with an associated battery charger.

FIG. 24 shows a further alternative machine 258. Machine 258 includes features similar to machine 10 previously described except as otherwise indicated. Machine 258 includes an LC 260 with selectively individually movable LC shuttles 262 thereon. Machine 258 further includes a UC 264 which has selectively movable UC shuttles 266 selectively movable thereon. In this exemplary arrangement the machine controller 140 includes an interface 150 that comprises a wireless transceiver. The wireless transceiver is operative to communicate via radio signals, with the wireless transceiver interface component 106 in each respective LC and UC shuttle so as to cause the machine controller 140 to control the movement thereof.

In this exemplary arrangement the LC shuttles and UC shuttles include rechargeable batteries as part of the power supply component 104. Such rechargeable batteries require periodic recharging in order to maintain the shuttles in operation. In this exemplary arrangement each of the LC track 260 and the UC track 264 include a spur, however only the LC spur 268 is schematically shown. In the exemplary arrangement the spur 268 is engageable with the LC track to enable each respective LC track shuttle to be operatively engaged with the spur. In the exemplary arrangement a battery charger 270 is operatively engageable with shuttles 262 which are in engagement with the spur. This is represented in FIG. 24 by an LC shuttle 272.

In exemplary arrangements a shuttle that has been moved responsive to operation of the machine controller to be located on the spur may be operatively engaged with the battery charger 270. In some exemplary arrangements the battery charger may provide a wired contact connection or a wireless connection for purposes of charging the batteries included in the adjacent shuttle. For example in some arrangements the battery charger 270 may provide a releasable connector plug or engageable conductive contacts to provide charging power to a respective shuttle. In other exemplary arrangements the battery charger may include an inductive charging coil that is operative to provide power to an inductive charging coil located in an adjacent shuttle. Of course these approaches for providing power for charging the batteries in a shuttle are exemplary and in other arrangements other approaches may be used.

Figure 25:
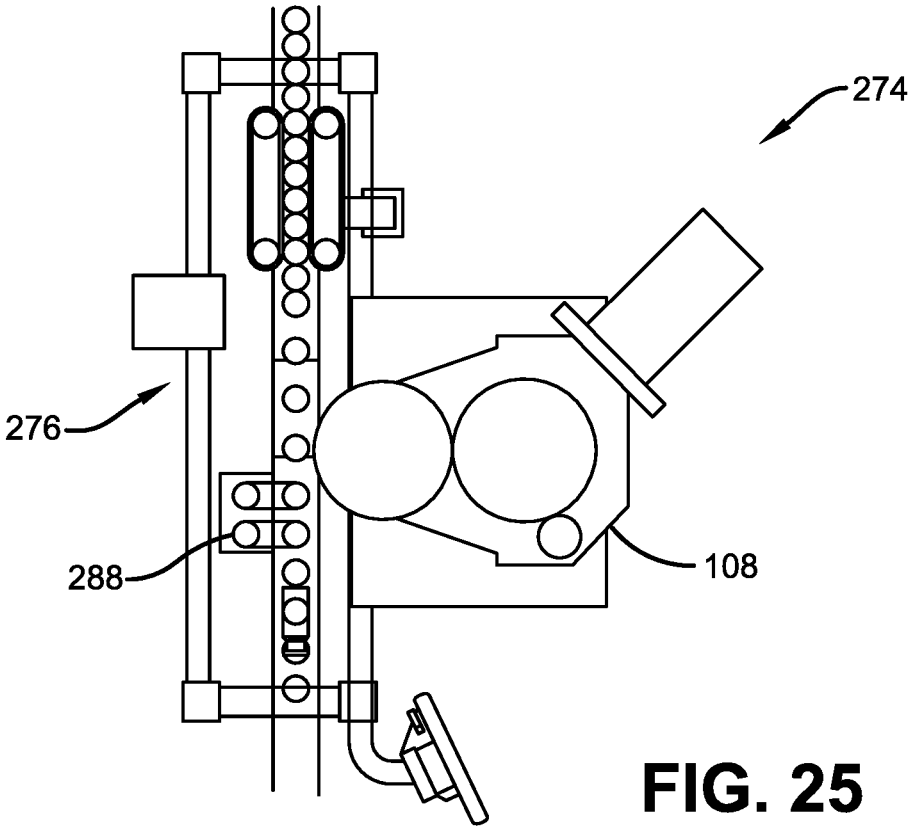
FIG. 25 is a top schematic view of an exemplary machine that includes battery powered LC shuttles, and an LC track spur with an LC shuttle charging station on the LC track.
Figure 26:
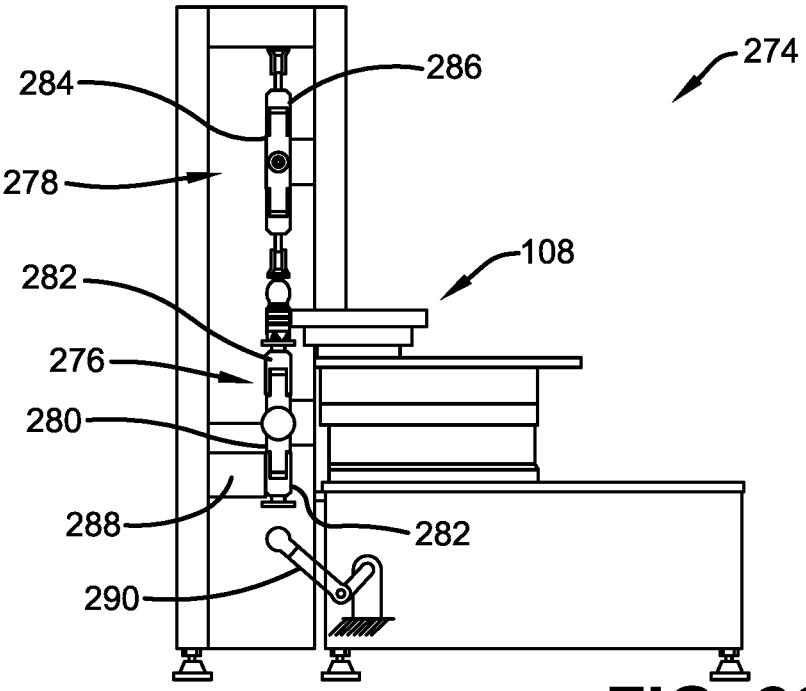
FIG. 26 is a side view of the machine shown in FIG. 25.

FIGS. 25 and 26 show a further exemplary arrangement of a machine 274. Machine 274 includes features like those described in connection with machine 10 except as otherwise expressly indicated. Machine 274 includes an LC 276 and a UC 278. The LC includes an LC track 280 with movable LC shuttles 282 thereon. UC 278 includes a UC track 284 with movable LC shuttles 286 thereon. In the exemplary machine the shuttles are displaceable transversely of the respective track onto a spur 288 that includes a battery charger. In the Figures this feature is shown only on the LC track 280 but it should be understood that in some exemplary arrangements such features may be included in both tracks. In the exemplary arrangement the shuttles are enabled to disengage from the respective UC or LC track and be moved transversely through engagement with a moving device 290, onto the spur 288 for charging. In some exemplary arrangements the moving device 290 may include a pneumatically or electronically controlled pusher or transfer slide. In other arrangements the moving device 290 may include a robotic arm or other mechanisms suitable to provide shuttle movement into engagement with the spur 288.

In various arrangements wireless or wired battery charging methods may be used for charging the shuttle batteries. In this manner the shuttles being recharged on the spur do not interfere with the movement of the shuttles on the respective adjacent track. After being recharged the shuttles may be moved through operation of the moving device 290 or other structure to disengage from the spur so that the shuttles may be utilized to engage and move containers on the respective track. Of course it should be understood that this approach is exemplary and in other arrangements other approaches may be used.

In some arrangements the UC and/or the LC may have multiple different types of LC shuttles and/or UC shuttles. Different shuttle configurations may be used with different container types and configurations. The controller may operate to cause the shuttles that do not correspond to the current container type being processed by the machine to be moved to be positioned on a spur. Then if responsive to user inputs through the user interface or in response to sensor signals, the controller determines that a different type of container is going to be processed, the controller operates to cause the shuttles for the different type of container to be moved off the spur onto the main part of the track and the shuttles for the containers no longer being processed are moved onto the spur. Of course this approach is exemplary and in other arrangements other approaches may be used.

Figure 27:
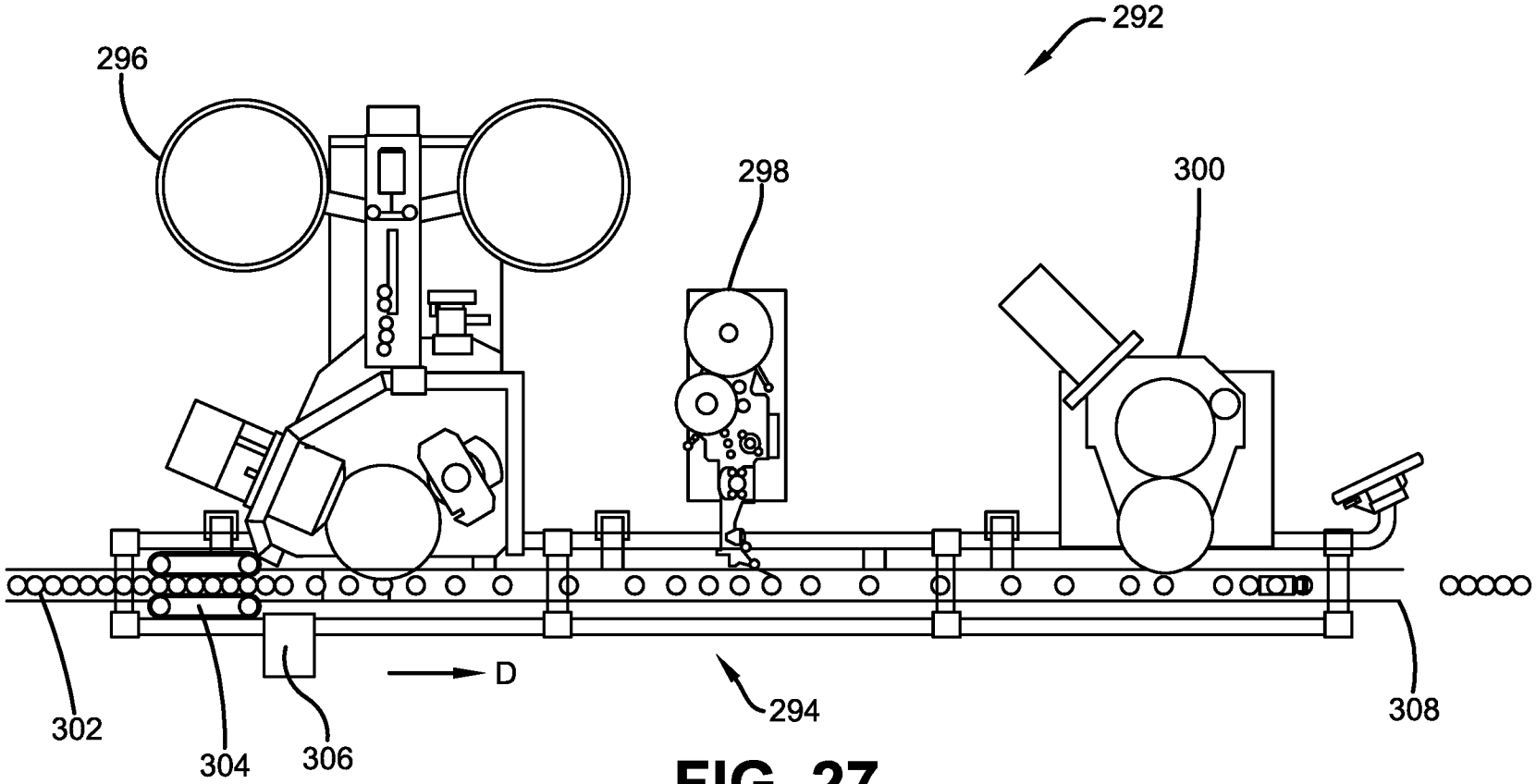
FIG. 27 is a top schematic view of an exemplary machine that includes a plurality of applicators positioned along the LC labeling track portion.

FIG. 27 shows an alternative configuration of an exemplary machine generally indicated 292. Machine 292 may include features like those discussed in connection with machine 10 except as described herein. It should be understood that in FIG. 27 only the LC labeling track portion 294 of the machine is shown. It should be understood that machine 292 includes an LC and a UC as well as a UC labeling track portion that corresponds to and extends vertically above the LC labeling track portion.

Machine 292 includes an LC and UC labeling track portion that is longer along the first direction D of container movement than the previously described arrangements. This may be achieved in some machine arrangements by utilizing additional straight and curved track pieces 40 like those previously discussed. In the exemplary arrangement shown, the machine 292 includes three applicators 296, 298 and 300. In the arrangement shown each of the applicators extend on a single lateral side of the machine. Each applicator is disposed from each other along the first direction of container movement. In the exemplary arrangement each of the applicators 296, 298, 300 may apply different kinds of labels or other markings to containers.

In the exemplary arrangement shown, containers are supplied to the machine on an in feed conveyor 302 in a manner similar to that discussed in connection with in feed conveyor 116. Incoming containers are held in a holding feeder 304 that may be similar to feeder 120. Containers are engaged in the shuttle engaged position between upper and lower shuttles and moved in the first direction by the shuttles. At least one feature sensor 306 is operative to sense at least one mark on each respective container and to place the container in a selected angular or other registration position as required for the application of markings by applicator 296. The applicator 296 is operative to apply markings to each container that is engaged in operative connection therewith. After the applicator 296 has completed its marking function the container is moved in engagement with LC and UC shuttles to be in operative connection with applicator 298. Applicator 298 provides further markings to the container. The container is thereafter engaged in the container engaged position in operative connection with applicator 300. Applicator 300 provides additional markings to the container which is then moved further in the first direction and released to an outlet conveyor 308. Of course it should be understood that machine 292 may include additional sensors and other features like those previously discussed for purposes of assuring that markings have been applied properly to each of the containers by each of the applicators.

Figure 28:
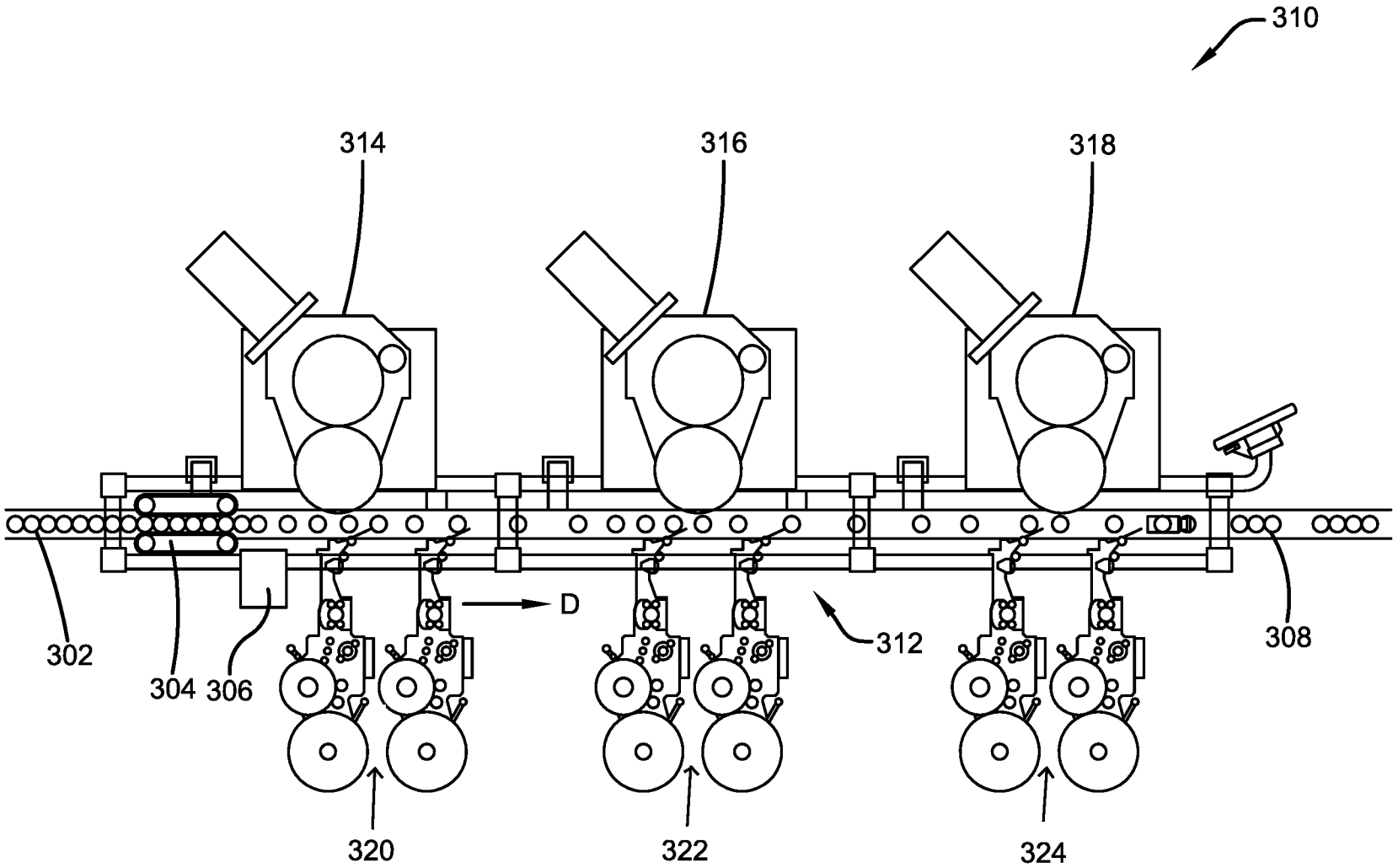
FIG. 28 is a top schematic view of a further exemplary machine that includes a plurality of applicators along the LC labeling track portion.

FIG. 28 shows yet another exemplary machine 310. Machine 310 may be similar to machine 10 and machine 292 previously discussed, except as otherwise specified. Again as was the case with FIG. 27, only the LC labeling track portion 312 of the machine is shown in the Figure. In this exemplary arrangement six applicators are positioned in operative connection with the LC labeling track portion. In this exemplary arrangement three applicators 314, 316 and 318 are positioned on a first transverse side of the LC labeling track portion. On the opposed side of the LC labeling track portion are three pairs of applicators 320, 322 and 324. In the exemplary arrangement each applicator in each pair is of the same type. Of course this approach is exemplary and in other arrangements other approaches may be used.

The configuration of applicators in exemplary machine 310 may be used when numerous different types of labels or other markings are to be applied to each container. In some arrangements each applicator may apply a specific label or other marking that is different from that applied by each of the other applicators. Alternatively such an arrangement may be utilized to help assure that the machine 310 remains operational even in circumstances when one or more applicators go out of service. For example in some arrangements, applicators 314, 316 and 318 may all be configured to apply the same type of marking to a container. In this manner only one of these applicators needs to be operational to perform the function of the machine. If the applicator that is being operated runs out of marking material or malfunctions, another one of the applicators can be automatically started through operation of the machine controller. Similarly in some arrangements only one applicator among the three pairs of applicators 320, 322 and 324 needs to be operational for the machine to perform its functions. Again in the event of an applicator malfunction the other applicator in the same pair, or an applicator in a different pair may be made operational responsive to operation of the machine controller to apply the necessary markings. This exemplary configuration helps to assure that the machine 310 should always be capable of providing the necessary marking functions even if one or more of the applicators are not operational.

It should be understood that the machine configurations shown herein are merely exemplary of numerous different machine configurations that may be produced utilizing the principles that have been described. Further it should be understood that arrangements with independently movable shuttles may move the shuttles selectively in both directions to cause containers to be marked by applicators in different sequences and/or to be marked by a single applicator multiple times.

The exemplary machine arrangements described herein present a number of potential advantages compared to prior machines and marking systems. For example, the ability to move each of the shuttles independently on a respective track provides greater flexibility for handling different types of containers, as well as for selectively rotating or otherwise positioning containers that are in operative connection with applicators. Exemplary arrangements also provide the capability for engaging containers of different physical sizes with the same LC shuttles and UC shuttles. Different requirements for rotation or other positioning of the containers during marking by different applicators may be accomplished by changing the programming associated with the machine controller so that containers are selectively oriented and/or undergo the necessary degree of rotation or other movement to successfully apply the markings when in operative engagement with a particular applicator.

Further exemplary arrangements may have the capability to change the vertical distance between LC and UC shuttles. This provides the capability to reconfigure the machine for containers having different vertical heights. Other arrangements provide the capability for readily discontinuing the use of existing shuttles that are used in connection with moving one type of container on a respective track, and replacing the existing shuttles with different shuttles that are configured to handle a different type of container. This may include for example, shuttles that are made to physically engage containers with different types of cross-sectional configurations, bottom ends and/or upper portions, from those handled by the shuttles that are discontinued. Further exemplary arrangements enable the setting of parameters such as different speeds, distances and spacing between applicators, as well other features and parameters that may be desirable to carry out the marking of containers through operation of the machine.

Exemplary machine arrangements described herein may provide potential advantages compared to labeling and marking systems of the rotating carousel type. Such rotating carousel machines commonly support containers positioned on platforms that have a platform axis of rotation that is parallel to the central axis of the carousel. However, when it is desired to change the type of container that is to be marked through operation of the machine, such as to enable the machine to apply markings to containers with a different diameter in axially transverse cross section, considerable machine modification and set up may be required. Such modifications may include a requirement to change to a different diameter carousel. A different number of container supporting platforms as well as a different number and/or type of marking units may also be required when changing from one container configuration to another.

For example, a carousel machine with a primitive diameter of 600 mm will often have a periphery barely large enough to accommodate four labeling/marking units. If it is desired to add an additional labeling/marking unit, adequate additional space is not available to do so. Likewise, if it is necessary to add an additional labeling/marking unit, a laser marker, a vision system to detect labeling/marking quality, or other type unit to the machine, the absence of available space would necessitate the use of a larger diameter carousel to accommodate the additional component about the machine periphery.

With carousel machines when it is desired to increase production speed, it is often necessary to increase the number of platforms. In a carousel machine this would usually require an increase in the diameter of the carousel. A change in the diameter of the carousel changes the machine pitch which is the distance between one container and the next container in engagement with the machine. A further consideration is that the application of a label or other marking on a container, whether a partial cold glue label, a self adhesive label, or a wrapping hot melt label, must occur so that the peripheral speeds of the of the labeling/marking device and the external peripheral surface of the container correspond. The necessity to have a common speed for both the label or other marking that is being applied and the peripheral outer surface of the container, is essential to avoid the formation of folds, label slippage, incorrect positioning or other improper markings being applied to the container. This means that the peripheral speed of the applied label or other marking must coincide with the product of the angular velocity of the carousel multiplied by the sum of the radius of the carousel and the radius of the container. The greater the radius of the container, the greater the application speed that must be employed by the labeling or other marking device. As a result the length of the label or other markings to be applied as well as the physical dimensions of the carousel and the container, and the necessary speed for the application of the label or marking must be taken into consideration in the sizing of the pitch of the machine.

With some existing rotating carousel machines it may be difficult to apply a label or other marking that is longer than the machine pitch. As a result for many such machines the machine pitch determines the maximum length of the label or marking that can be applied to a container. Further because the perimeter of the carousel of such machines is circular, the coupling of the labeling or other marking units to the carousel machine must be carried out on the rounded outer periphery. The need to operate the labeling or other marking units so as to achieve proper marking of containers traveling on a generally circular path may present additional complexities.

For some existing rotating carousel machines the changes needed to process containers of different sizes may include a requirement for changing numerous different parts of the machine. Such parts that may need to be changed may include spacing screws, inlet and outlet stars, counter guides and numerous other components. Such items may need to be changed each time the machine needs to be changed to process a dimensionally different type of container. Such changeovers to allow carousel machines to handle different container configurations can be expensive both in terms of the need to acquire different suitable parts to install on the machine as well as the cost of the labor and production downtime necessary to make the machine modifications.

For some of the exemplary machines described herein the absence of the carousel avoids or substantially reduces drawbacks that may be encountered with certain existing types of machines. Exemplary arrangements of the machines described herein may also include the ability to be more readily and inexpensively configured to handle different sizes of containers as well as to change the number, location and type of applicators that apply markings to containers. Exemplary arrangements may also enable the application of different types of markings and/or markings with larger dimensions or other properties than might be possible with some existing machines. Further some exemplary arrangements of the machines described herein may provide advantages in terms of requiring less space for machine operation as well as the capability to provide different desired speeds and production rates. Numerous other potential benefits of the described exemplary machine arrangements will be apparent to those having skill in the field of applying labels or other markings to containers.

Thus the exemplary arrangements described herein achieve improved operation, eliminate difficulties encountered in the use of prior machines and systems, and attain the useful results described herein.

In the foregoing description, certain terms have been used for brevity, clarity and understanding. However no unnecessary limitations are to be implied therefrom because such terms are used for descriptive purposes and are intended to be broadly construed. Moreover the descriptions and illustrations herein are by way of examples, and the new and useful features and details are not limited to the exact features and details shown or described. Further as used herein the terms generally and substantially shall be construed as meaning mostly with regard to the referenced feature, condition or property.

It should be further understood that the features and/or relationships associated with one arrangement that has been described herein may be combined with features and/or relationships of another arrangement that has been shown or described. That is, various features and/or relationships from various arrangements can be combined in further arrangements. The scope of the disclosure is not limited merely to the arrangements that have been specifically shown or described.

Having described features, discoveries and principles of the exemplary arrangements, the manner in which they are constructed and operated, and the advantages and useful results attained, the new and useful features, devices, elements, arrangements, parts, combinations, systems, equipment, operations, methods, processes and relationships are set forth in the appended claims.

I claim:

1. Apparatus comprising:

a machine that is operative to apply markings to containers,
wherein each of the containers include
a bottom end, and
an upper portion disposed away from the bottom end, the machine including:

a lower conveyor (LC), wherein the LC includes
a continuous LC track, wherein the LC track includes
a substantially linearly straight, horizontally extending LC labeling track portion,
wherein the LC labeling track portion extends from an LC inlet end to an LC outlet end,
a return LC track portion, wherein the return LC track portion extends
vertically below the LC labeling track portion, and
from the LC outlet end to the LC inlet end, an upper conveyor (UC), wherein the UC includes
a continuous UC track, wherein the UC track includes
a substantially linearly straight, horizontally extending UC labeling track portion,
wherein the UC labeling track portion
is disposed vertically above and in aligned relation with the LC labeling track portion,
extends intermediate of a UC inlet end and a UC outlet end, and
extends parallel to the LC labeling track portion continuously between the UC inlet end and the UC outlet end,
a return UC track portion,
wherein the return UC track portion extends
vertically above the UC labeling track portion, and
from the UC outlet end to the UC inlet end, wherein the LC track and the UC track extend in a common vertical plane, at least one jack, wherein the at least one jack is in in operative connection with the LC and the UC, wherein the at least one jack is operative to selectively change a vertical distance between the LC labeling track portion and the UC labeling track portion, at least one LC shuttle,
wherein each LC shuttle
is in operative connection with the LC,
is movable along the entire LC track,
includes a container engagement platform,
wherein the container engagement platform is configured to engage the bottom end of only one container, and
is rotatably movable relative to the respective LC shuttle, at least one UC shuttle,
wherein each UC shuttle
is in operative connection with the UC,
is movable along the entire UC track,
includes a container engagement fixture thereon,
wherein the container engagement fixture is configured to engage the upper portion of only one container, wherein at least one of the LC track and the UC track includes a drive track and a driven track in parallel side by side relation, wherein the drive track includes at least one drive track carrier that is selectively movable in operative engagement with the drive track about the entire drive track and in both a first direction and in a second direction opposed of the first direction, wherein the driven track includes the at least one driven shuttle in operative engagement with the driven track, wherein the at least one driven shuttle is movable in engagement with the driven track about the entire driven track and in both the first direction and the second direction, wherein the at least one driven shuttle includes the container engagement platform or the container engagement fixture, a releasable connector, wherein the releasable connector is operative to selectively operatively engage a respective driven shuttle and a respective drive track carrier, wherein a respective driven shuttle is selectively moveable on the driven track through operative connection with a respective drive track carrier through engagement of the releasable connector, an applicator, wherein the applicator is in an applicator position, wherein the applicator position is disposed adjacent to the LC labeling track portion and the UC labeling track portion, horizontally intermediate of the LC inlet end and the LC outlet end, is operative to apply at least one marking to a container in operative engagement with the applicator in the applicator position, wherein the machine is operative to move one respective LC shuttle and one respective UC shuttle into vertically aligned relation to engage the container in a shuttle engaged position, wherein in the shuttle engaged position the container is vertically between and in operative engagement with both the respective LC shuttle and the respective UC shuttle, wherein in the shuttle engaged position the bottom end of the container is in operatively engaged relation with the container engagement platform of the respective LC shuttle and the upper end of the container is in operatively engaged relation with the container engagement fixture of the respective UC shuttle, move the respective LC shuttle and the respective UC shuttle in coordinated relation in the first direction along the LC labeling track and UC labeling track respectively while holding the container in the shuttle engaged position, into the applicator position wherein the container is in operative engagement with the applicator, operate the applicator to apply at least one marking to the container in the applicator position and while the container is in the shuttle engaged position, move the marked container in the shuttle engaged position in the first direction away from the applicator position toward the LC outlet end, and release the container from operative engagement with the respective LC shuttle and the respective UC shuttle.

2. Apparatus comprising:

a machine that is operative to apply markings to containers, wherein each of the containers include a bottom end, and an upper portion disposed away from the bottom end, the machine including:

a lower conveyor (LC), wherein the LC includes a continuous LC track, wherein the LC track includes a substantially linearly straight, horizontally extending LC labeling track portion, wherein the LC labeling track portion extends from an LC inlet end to an LC outlet end, a return LC track portion, wherein the return LC track portion extends vertically below the LC labeling track portion, and from the LC outlet end to the LC inlet end, an upper conveyor (UC), wherein the UC includes a continuous UC track, wherein the UC track includes a substantially linearly straight, horizontally extending UC labeling track portion, wherein the UC labeling track portion is disposed vertically above and in aligned relation with the LC labeling track portion, extends intermediate of a UC inlet end and a UC outlet end, and extends parallel to the LC labeling track portion continuously between the UC inlet end and the UC outlet end, a return UC track portion, wherein the return UC track portion extends vertically above the UC labeling track portion, and from the UC outlet end to the UC inlet end, at least one jack, wherein the at least one jack is in operative connection with the LC and the UC, wherein the at least one jack is operative to selectively change a vertical distance between the LC labeling track portion and the UC labeling track portion, wherein the UC track is vertically disposed further away from the LC track than the vertical distance, in a first direction along the UC track away from the UC inlet end beyond the UC outlet end, at least one LC shuttle, wherein each LC shuttle is in operative connection with the LC, is movable along the entire LC track, includes a container engagement platform, wherein the container engagement platform is configured to engage the bottom end of only one container, and is rotatably movable relative to the respective LC shuttle, a drive, wherein the drive is in operative connection with the container engagement platform, wherein the drive includes at least one of a motor, a belt, a roller, a cam, and a gear rack, a feature sensor, wherein the feature sensor is in operative connection with the drive, wherein the feature sensor is operative to sense at least one feature of a container that is in engagement with the container engagement platform, and wherein the drive is operative to rotatably position the container through rotation of the container engagement platform responsive at least in part to the sensed at least one feature, at least one UC shuttle, wherein each UC shuttle is in operative connection with the UC, is movable along the entire UC track, includes a container engagement fixture thereon, wherein the container engagement fixture is configured to engage the upper portion of only one container, an applicator, a movable applicator mount, wherein the applicator is in operatively supported connection with the applicator mount, wherein the applicator is in an applicator position, wherein the applicator position is disposed adjacent to the LC labeling track portion and the UC labeling track portion, horizontally intermediate of the LC inlet end and the LC outlet end, and selectively variable from the UC inlet end along the first direction responsive to movement of the applicator mount, is operative to apply at least one marking to the container in operative engagement with the applicator in the applicator position, wherein the machine is operative to move one respective LC shuttle and one respective UC shuttle into vertically aligned relation to engage the container in a shuttle engaged position, wherein in the shuttle engaged position the container is vertically between and in operative engagement with both the respective LC shuttle and the respective UC shuttle, wherein in the shuttle engaged position the bottom end of the container is in operatively engaged relation with the container engagement platform of the respective LC shuttle and the upper end of the container is in operatively engaged relation with the container engagement fixture of the respective UC shuttle, move the respective LC shuttle and the respective UC shuttle in coordinated relation in the first direction along the LC labeling track and UC labeling track respectively while holding the container in the shuttle engaged position, into the applicator position wherein the container is in operative engagement with the applicator, at least one of before and when the container is in the applicator position, selectively rotationally position the container through rotation of the container engagement platform, responsive at least in part to the sensed at least one feature, operate the applicator to apply at least one marking to the container in the applicator position and while the container is in the shuttle engaged position, move the marked container in the shuttle engaged position in the first direction away from the applicator position toward the LC outlet end, and release the container from operative engagement with the respective LC shuttle and the respective UC shuttle.

3. The apparatus according to claim 2 wherein the at least one feature sensed by the feature sensor includes at least one of a mold line, a registration mark, and a closure piece.

4. The apparatus according to claim 2 wherein the container engagement fixture is rotatably movable relative to the respective UC shuttle, wherein in the shuttle engaged position the container engagement fixture is rotatable coaxially with the container engagement platform.

5. The apparatus according to claim 4 wherein the upper portion of each container includes a top, wherein the container engagement fixture is configured to be in engagement with the top in the shuttle engaged position.

6. The apparatus according to claim 4 wherein the applicator includes at least one of a pressure sensitive labeling station, a cold glue labeling station, a cut and stack hot melt labeling station, a roll fed hot melt labeling station, a sleeve labeling station, and a printing station.

7. The apparatus according to claim 6 wherein the machine includes a plurality of applicators, wherein the plurality of applicators are positioned intermediate of the LC inlet end and the LC outlet end and each applicator spaced in the first direction from another applicator.

8. The apparatus according to claim 6 and further comprising:

a controller, wherein the controller includes control circuitry, at least one incoming container position sensor, wherein the at least one incoming container position sensor is operative to sense the container proximate to the LC inlet end and the UC inlet end, wherein the controller is in operative connection with the LC, the UC and the at least one incoming container position sensor, wherein the controller is operative to cause the respective LC shuttle and UC shuttle to operatively engage the container in the shuttle engaged position.

9. The apparatus according to claim 8 and further comprising:

at least one optical sensor, wherein the at least one optical sensor is in operative connection with the controller and is disposed in the first direction from the applicator position, wherein the at least one optical sensor is operative to sense at least one optical characteristic of the marking on the container applied by the applicator, wherein the control circuitry includes a data store, wherein the data store includes quality data, wherein the quality data corresponds to at least one of a proper container application of the marking, an improper container application of the marking, wherein the controller is operative responsive at least in part to the at least one optical characteristic sensed by the at least one optical sensor and the quality data, to cause a determination of an improper container application of the marking on the container, responsive at least in part to the determination, generation of at least one signal that is operative to cause the container to be segregated from other containers having a properly applied marking.

10. The apparatus according to claim 9 wherein at least one of the LC or the UC includes a movable continuous drive chain, wherein the drive chain extends along the respective LC track or UC track, wherein each respective LC shuttle or UC shuttle is in operative connection with the drive chain and is movable about the respective LC track or UC track responsive to drive chain movement.

11. The apparatus according to claim 9 wherein each LC shuttle or UC shuttle includes a respective shuttle drive, wherein each LC shuttle or UC shuttle is selectively movable on the respective LC track or UC track responsive to operation of the respective shuttle drive independent of movement of every other respective LC shuttle or UC shuttle.

12. The apparatus according to claim 11 and further comprising:

a wireless transceiver in operative connection with the controller, wherein at least one LC shuttle or UC shuttle includes a shuttle wireless transceiver, wherein the at least one LC shuttle or UC shuttle is operative to operate the drive responsive at least in part to wireless communications with the controller.

13. The apparatus according to claim 12 wherein the at least one LC shuttle or UC shuttle that includes the shuttle wireless transceiver further includes a battery, wherein the battery is operative to power the shuttle wireless transceiver.

14. The apparatus according to claim 13
wherein each LC shuttle or UC shuttle includes the respective shuttle drive and a respective battery,
wherein the respective LC track or UC track includes a spur that extends adjacent the LC track or UC track,
wherein an LC shuttle or a UC shuttle is movable onto the spur and may remain stationary on the spur while other LC shuttles or UC shuttles continue to move continuously around the respective LC track or UC track.

15. The apparatus according to claim 14
wherein the spur includes a battery charger,
wherein the battery charger is operative to charge the respective battery of a respective LC shuttle or UC shuttle on the spur.

16. The apparatus according to claim 9
wherein one of the LC or the UC includes a movable continuous drive chain,
wherein the drive chain extends along the respective LC track or UC track,
wherein each respective LC shuttle or UC shuttle is in operative connection with the drive chain and is movable about the respective LC track or UC track responsive to drive chain movement,
and
wherein each at least one LC shuttle or at least one UC shuttle of the other of the LC or the UC includes a respective shuttle drive,
wherein each respective LC shuttle or UC shuttle is selectively movable on the respective LC track or UC track responsive to operation of the respective shuttle drive independent of movement of every other respective LC shuttle or UC shuttle.

17. The apparatus according to claim 10
and further comprising:
an actuator in operative connection with each respective LC shuttle or UC shuttle, wherein the actuator is operative to selectively operatively engage and disengage the respective LC shuttle or UC shuttle and the drive chain.

18. Apparatus comprising:
a machine that is operative to apply markings to containers,
wherein each of the containers include
a bottom end, and
an upper portion disposed away from the bottom end,
the machine including:
a lower conveyor (LC), wherein the LC includes
a continuous LC track, wherein the LC track includes
a substantially linearly straight, horizontally extending LC labeling track portion,
wherein the LC labeling track portion extends from an LC inlet end to an LC outlet end,
a return LC track portion, wherein the return LC track portion extends
vertically below the LC labeling track portion, and from the LC outlet end to the LC inlet end,
an upper conveyor (UC), wherein the UC includes
a continuous UC track, wherein the UC track includes
a substantially linearly straight, horizontally extending UC labeling track portion,
wherein the UC labeling track portion
is disposed vertically above and in aligned relation with the LC labeling track portion,
extends intermediate of a UC inlet end and a UC outlet end,
a return UC track portion,
wherein the return UC track portion extends
vertically above the UC labeling track portion, and from the UC outlet end to the UC inlet end,
at least one LC shuttle,
wherein each LC shuttle
is in operative connection with the LC,
is movable along the entire LC track,
includes a container engagement platform,
wherein the container engagement platform is configured to engage the bottom end of only one container, and
is rotatably movable relative to the respective LC shuttle,
at least one UC shuttle,
wherein each UC shuttle
is in operative connection with the UC,
is movable along the entire UC track,
includes a container engagement fixture thereon,
wherein the container engagement fixture is configured to engage the upper portion of only one container,
an applicator,
a movable applicator mount, wherein the applicator is in operatively supported connection with the applicator mount,
wherein the applicator
is in an applicator position, wherein the applicator position is
disposed adjacent to the LC labeling track portion and the UC labeling track portion,
horizontally intermediate of the LC inlet end and the LC outlet end, and
selectively variable from the LC inlet end in a first direction along the LC labeling track and the UC labeling track responsive to movement of the applicator mount,
is operative to apply at least one marking to a container in operative engagement with the applicator in the applicator position,
wherein the machine is operative to
move one respective LC shuttle and one respective UC shuttle into vertically aligned relation to engage the container in a shuttle engaged position, wherein in the shuttle engaged position the container is vertically between and in operative engagement with both the respective LC shuttle and the respective UC shuttle,
wherein in the shuttle engaged position the bottom end of the container is in operatively engaged relation with the container engagement platform of the respective LC shuttle and the upper end of the container is in operatively engaged relation with the container engagement fixture of the respective UC shuttle,
move the respective LC shuttle and the respective UC shuttle in coordinated relation in the first direction while holding the container in the shuttle engaged position, into the applicator position wherein the container is in operative engagement with the applicator,
operate the applicator to apply at least one marking to the container in the applicator position and while the container is in the shuttle engaged position,
move the marked container in the shuttle engaged position in the first direction away from the applicator position toward the LC outlet end, and
release the container from operative engagement with the respective LC shuttle and the respective UC shuttle.

19. The apparatus according to claim 18
and further comprising:
at least one jack, wherein the at least one jack is in operative connection with the LC and the UC,
wherein the at least one jack is operative to selectively change a vertical distance between the LC labeling track portion and the UC labeling track portion.

20. The apparatus according to claim 18
and further comprising:
a drive, wherein the drive is in operative connection with the container engagement platform,
a feature sensor, wherein the feature sensor is in operative connection with the drive,
wherein the feature sensor is operative to sense at least one feature of the container and wherein the drive is operative to rotatably position the container through rotation of the container engagement platform responsive at least in part to the sensed at least one feature.

21. The apparatus according to claim 18
wherein the applicator mount enables the applicator position to be selectively variable in a transverse direction, wherein the transverse direction is perpendicular to the first direction.

22. The apparatus according to claim 18
wherein the container engagement fixture is rotatably movable relative to the respective UC shuttle,
wherein in the shuttle engaged position the container engagement fixture is rotatable coaxially with the container engagement platform,
wherein the container engagement fixture and the container engagement platform each rotate while the applicator is operative to apply the at least one marking to the container.

23. The apparatus according to claim 18
and further comprising:
a controller, wherein the controller includes control circuitry,
at least one incoming container position sensor,
wherein the at least one incoming container position sensor is operative to sense the container proximate to the LC inlet end and the UC inlet end,
wherein the controller is in operative connection with the LC, the UC and the at least one incoming container position sensor,
wherein the controller is operative to cause the respective LC shuttle and respective UC shuttle to concurrently move about the respective LC track and UC track to operatively engage the container in the shuttle engaged position.

24. The apparatus according to claim 18
wherein at least one of each LC shuttle or UC shuttle includes a respective shuttle drive,
wherein each respective LC shuttle or UC shuttle is selectively movable on the respective LC track or UC track in both the first direction and a second direction opposed of the first direction responsive to operation of the respective shuttle drive independent of movement of every other respective LC shuttle or UC shuttle.

25. The apparatus according to claim 18
wherein at least one of the LC or the UC includes a movable continuous drive chain,
wherein the drive chain extends along the respective LC track or UC track,
an actuator in operative connection with each respective at least one LC shuttle or UC shuttle, wherein the actuator is operative to selectively operatively engage and disengage the respective LC shuttle or UC shuttle and the drive chain,
wherein each of the at least one respective LC shuttle or UC shuttle is enabled to be selectively operatively disengaged from the drive chain and engaged in operative connection with the drive chain and moved about the respective LC track or UC track responsive to chain movement.

26. The apparatus according to claim 18
wherein the machine includes a frame, wherein the frame includes at least one horizontally extending strut,
wherein the applicator mount is movable along the first direction in operative connection with the at least one horizontally extending strut,
and further comprising at least one releasable clamp, wherein the at least one releasable clamp is in operative connection with the applicator mount, wherein the at least one clamp is selectively engageable in fixed operative engagement with the at least one horizontally extending strut,
wherein when the clamp is in fixed operative engagement with the at least one horizontally extending strut the applicator is held in a fixed position along the first direction relative to the LC and the UC.

27. The apparatus according to claim 18
wherein the machine further includes a frame,
wherein the applicator mount is movably mounted in operatively supported connection with the frame,
wherein the applicator mount is selectively movable in operatively supported connection with the frame along the first direction and along a second direction transverse of the first direction.

28. The apparatus according to claim 27
and further comprising a releasable clamp,
wherein the releasable clamp is in operative connection with the applicator mount and the frame,
wherein the releasable clamp is changeable between a movable condition and a fixed engaged condition, wherein in the movable condition of the clamp the applicator mount is movable relative to the frame at least along the first direction, and in the engaged condition of the clamp the applicator mount is held in fixed operative engagement with the frame.

29. The apparatus according to claim 28
wherein the frame includes at least one horizontally extending strut,
wherein in the movable condition of the clamp, the applicator mount is movable along the first direction in operatively supported connection with the at least one horizontally extending strut.

30. Apparatus comprising:
a machine that is operative to apply markings to containers,
wherein each of the containers include
a bottom end, and
an upper portion disposed away from the bottom end,
the machine including:
a lower conveyor (LC), wherein the LC includes
a continuous LC track, wherein the LC track includes
a substantially linearly straight, horizontally extending LC labeling track portion,
wherein the LC labeling track portion extends from an LC inlet end to an LC outlet end,
a return LC track portion, wherein the return LC track portion extends vertically below the LC labeling track portion, and
from the LC outlet end to the LC inlet end, an upper conveyor (UC), wherein the UC includes
a continuous UC track, wherein the UC track includes
a substantially linearly straight, horizontally extending UC labeling track portion,
wherein the UC labeling track portion
is disposed vertically above and in aligned relation with the LC labeling track portion,
extends intermediate of a UC inlet end and a UC outlet end,
a return UC track portion,
wherein the return UC track portion extends
vertically above the UC labeling track portion, and
from the UC outlet end to the UC inlet end, at least one LC shuttle,
wherein each LC shuttle
is in operative connection with the LC,
is movable along the entire LC track,
includes a container engagement platform,
wherein the container engagement platform is configured to engage the bottom end of only one container, and
is rotatably movable relative to the respective LC shuttle, at least one UC shuttle,
wherein each UC shuttle
is in operative connection with the UC,
is movable along the entire UC track,
includes a container engagement fixture thereon,
wherein the container engagement fixture is configured to engage the upper portion of only one container, an applicator, wherein the applicator
is in an applicator position, wherein the applicator position is
disposed adjacent to the LC labeling track portion and the UC labeling track portion,
horizontally intermediate of the LC inlet end and the LC outlet end,
is operative to apply at least one marking to a container in operative engagement with the applicator in the applicator position, a controller, wherein the controller includes control circuitry, at least one incoming container position sensor,
wherein the at least one incoming container position sensor is operative to sense the container proximate to the LC inlet end and the UC inlet end, wherein the controller is in operative connection with the LC, the UC and the at least one incoming container position sensor, wherein the controller is operative to cause the respective LC shuttle and respective UC shuttle to concurrently move about the respective LC track and UC track to operatively engage the container in a shuttle engaged position, wherein in the shuttle engaged position the container is vertically between and in operative engagement with both the respective LC shuttle and the respective UC shuttle, wherein in the shuttle engaged position the bottom end of the container is in operatively engaged relation with the container engagement platform of the respective LC shuttle and the upper end of the respective container is in operatively engaged relation with the container engagement fixture of the respective UC shuttle, wherein the machine is operative to
move the respective LC shuttle and the respective UC shuttle in coordinated relation in a first direction along the LC labeling track and UC labeling track respectively while holding the container in the shuttle engaged position, into the applicator position wherein the container is in operative engagement with the applicator,
operate the applicator to apply at least one marking to the container in the applicator position and while the container is in the shuttle engaged position,
move the marked container in the shuttle engaged position in the first direction away from the applicator position toward the LC outlet end, and
release the container from operative engagement with the respective LC shuttle and the respective UC shuttle.

31. Apparatus comprising:

a machine that is operative to apply markings to containers,
wherein each of the containers include
a bottom end, and
an upper portion disposed away from the bottom end, the machine including:

a lower conveyor (LC), wherein the LC includes
a continuous LC track, wherein the LC track includes
a substantially linearly straight, horizontally extending LC labeling track portion,
wherein the LC labeling track portion extends from an LC inlet end to an LC outlet end,
a return LC track portion, wherein the return LC track portion extends
vertically below the LC labeling track portion, and
from the LC outlet end to the LC inlet end, an upper conveyor (UC), wherein the UC includes
a continuous UC track, wherein the UC track includes
a substantially linearly straight, horizontally extending UC labeling track portion,
wherein the UC labeling track portion
is disposed vertically above and in aligned relation with the LC labeling track portion,
extends intermediate of a UC inlet end and a UC outlet end,
a return UC track portion,
wherein the return UC track portion extends
vertically above the UC labeling track portion, and
from the UC outlet end to the UC inlet end, at least one LC shuttle,
wherein each LC shuttle
is in operative connection with the LC,
is movable along the entire LC track,
includes a container engagement platform,
wherein the container engagement platform is configured to engage the bottom end of only one container, and
is rotatably movable relative to the respective LC shuttle, at least one UC shuttle,
wherein each UC shuttle
is in operative connection with the UC,
is movable along the entire UC track,
includes a container engagement fixture thereon,
wherein the container engagement fixture is configured to engage the upper portion of only one container,
an applicator, wherein the applicator
is in an applicator position, wherein the applicator position is
disposed adjacent to the LC labeling track portion and the UC labeling track portion,
horizontally intermediate of the LC inlet end and the LC outlet end,
is operative to apply at least one marking to a container in operative engagement with the applicator in the applicator position,
wherein the machine is operative to
move one respective LC shuttle and one respective UC shuttle into vertically aligned relation to engage the container in a shuttle engaged position, wherein in the shuttle engaged position the container is vertically between and in operative engagement with both the respective LC shuttle and the respective UC shuttle,
wherein in the shuttle engaged position the bottom end of the container is in operatively engaged relation with the container engagement platform of the respective LC shuttle and the upper end of the container is in operatively engaged relation with the container engagement fixture of the respective UC shuttle,
move the respective LC shuttle and the respective UC shuttle in coordinated relation in a first direction along the LC labeling track and UC labeling track respectively while holding the container in the shuttle engaged position, into the applicator position wherein the container is in operative engagement with the applicator,
operate the applicator to apply at least one marking to the container in the applicator position and while the container is in the shuttle engaged position,
move the marked container in the shuttle engaged position in the first direction away from the applicator position toward the LC outlet end, and
release the container from operative engagement with the respective LC shuttle and the respective UC shuttle,
wherein the machine further includes
at least one optical sensor, wherein the at least one optical sensor is
in operative connection with a controller including control circuitry,
disposed in the first direction from the applicator position,
operative to sense at least one optical characteristic of the at least one marking on the container applied by the applicator,
wherein the control circuitry includes at least one data store,
wherein the at least one data store includes quality data,
wherein the quality data corresponds to at least one of
a proper container application of the at least one marking,
an improper container application of the at least one marking,
wherein the controller is operative to cause rotation of the container in engagement with the container engagement platform while the at least one optical characteristic is sensed by the at least one optical sensor,
wherein the controller is operative responsive at least in part to the at least one optical characteristic sensed by the at least one optical sensor while the container is rotated and the quality data to cause
a determination of an improper container application of the at least one marking on the container,
responsive at least in part to the determination, generation of at least one signal that is operative at least in part to cause the container to be segregated from other containers that have the at least one marking properly applied.

32. The apparatus according to claim 31
and further comprising:
a movable applicator mount, wherein the applicator is in operatively supported connection with the applicator mount,
wherein the applicator position is selectively variable from the LC inlet end along the first direction responsive to movement of the applicator mount.

33. The apparatus according to claim 31
and further comprising:
a wireless transceiver in operative connection with the controller,
wherein each of the at least one LC shuttle or the at least one UC shuttle includes a shuttle wireless transceiver,
wherein each of the at least one LC shuttle or the at least one UC shuttle is operative to move along the respective LC track or UC track responsive at least in part to wireless communication with the controller.

34. Apparatus comprising:
a machine that is operative to apply markings to containers,
wherein each of the containers include
a bottom end, and
an upper portion disposed away from the bottom end,
the machine including:
a lower conveyor (LC), wherein the LC includes
a continuous LC track, wherein the LC track includes
a substantially linearly straight, horizontally extending LC labeling track portion,
wherein the LC labeling track portion extends from an LC inlet end to an LC outlet end,
a return LC track portion, wherein the return LC track portion extends
vertically below the LC labeling track portion, and from the LC outlet end to the LC inlet end,
an upper conveyor (UC), wherein the UC includes
a continuous UC track, wherein the UC track includes
a substantially linearly straight, horizontally extending UC labeling track portion,
wherein the UC labeling track portion
is disposed vertically above and in aligned relation with the LC labeling track portion,
extends intermediate of a UC inlet end and a UC outlet end,
a return UC track portion,
wherein the return UC track portion extends
vertically above the UC labeling track portion, and from the UC outlet end to the UC inlet end, at least one LC shuttle,
wherein each LC shuttle
is in operative connection with the LC,
is movable along the entire LC track,
includes a container engagement platform,
wherein the container engagement platform is configured to engage the bottom end of only one container, and
is rotatably movable relative to the respective LC shuttle,
at least one UC shuttle,
wherein each UC shuttle
is in operative connection with the UC,
is movable along the entire UC track,
includes a container engagement fixture thereon,
wherein the container engagement fixture is configured to engage the upper portion of only one container,
a controller, wherein the controller includes control circuitry,
a rotatable electrical connector, wherein the rotatable electrical connector includes at least one rotating cable extending therefrom,
wherein each of the at least one LC shuttle or the at least one UC shuttle is in electrical connection with the controller through the rotatable electrical connector and a respective rotating cable throughout movement of the respective LC track or UC track,
an applicator, wherein the applicator
is in an applicator position, wherein the applicator position is
disposed adjacent to the LC labeling track portion and the UC labeling track portion,
horizontally intermediate of the LC inlet end and the LC outlet end,
is operative to apply at least one marking to a container in operative engagement with the applicator in the applicator position,
wherein the machine is operative to
move one respective LC shuttle and one respective UC shuttle into vertically aligned relation to engage the container in a shuttle engaged position, wherein in the shuttle engaged position the container is vertically between and in operative engagement with both the respective LC shuttle and the respective UC shuttle,
wherein in the shuttle engaged position the bottom end of the container is in operatively engaged relation with the container engagement platform of the respective LC shuttle and the upper end of the container is in operatively engaged relation with the container engagement fixture of the respective UC shuttle,
move the respective LC shuttle and the respective UC shuttle in coordinated relation in a first direction along the LC labeling track and UC labeling track respectively while holding the container in the shuttle engaged position, into the applicator position wherein the container is in operative engagement with the applicator,
operate the applicator to apply at least one marking to the container in the applicator position and while the container is in the shuttle engaged position,
move the marked container in the shuttle engaged position in the first direction away from the applicator position toward the LC outlet end, and
release the container from operative engagement with the respective LC shuttle and the respective UC shuttle.

35. Apparatus comprising:
a machine that is operative to apply markings to containers,
wherein each of the containers include
a bottom end, and
an upper portion disposed away from the bottom end,
the machine including:
a lower conveyor (LC), wherein the LC includes
a continuous LC track, wherein the LC track includes
a substantially linearly straight, horizontally extending LC labeling track portion,
wherein the LC labeling track portion extends from an LC inlet end to an LC outlet end,
a return LC track portion, wherein the return LC track portion extends
vertically below the LC labeling track portion, and
from the LC outlet end to the LC inlet end,
an upper conveyor (UC), wherein the UC includes
a continuous UC track, wherein the UC track includes
a substantially linearly straight, horizontally extending UC labeling track portion,
wherein the UC labeling track portion
is disposed vertically above and in aligned relation with the LC labeling track portion,
extends intermediate of a UC inlet end and a UC outlet end,
a return UC track portion,
wherein the return UC track portion extends
vertically above the UC labeling track portion, and
from the UC outlet end to the UC inlet end,
at least one LC shuttle,
wherein each LC shuttle
is in operative connection with the LC,
is movable along the entire LC track,
includes a container engagement platform,
wherein the container engagement platform is configured to engage the bottom end of only one container, and
is rotatably movable relative to the respective LC shuttle,
at least one UC shuttle,
wherein each UC shuttle
is in operative connection with the UC,
is movable along the entire UC track,
includes a container engagement fixture thereon,
wherein the container engagement fixture is configured to engage the upper portion of only one container,
a controller, wherein the controller includes control circuitry,
a wireless transceiver in operative connection with the controller, wherein each of the at least one LC shuttle or the at least one UC shuttle includes a shuttle wireless transceiver,
wherein each of the at least one LC shuttle or the at least one UC shuttle is operative to move along the respective LC track or UC track responsive at least in part to wireless communication with the controller,
an applicator, wherein the applicator
is in an applicator position, wherein the applicator position is
disposed adjacent to the LC labeling track portion and the UC labeling track portion,
horizontally intermediate of the LC inlet end and the LC outlet end, is operative to apply at least one marking to a container in operative engagement with the applicator in the applicator position, wherein the machine is operative to move one respective LC shuttle and one respective UC shuttle into vertically aligned relation to engage the container in a shuttle engaged position, wherein in the shuttle engaged position the container is vertically between and in operative engagement with both the respective LC shuttle and the respective UC shuttle, wherein in the shuttle engaged position the bottom end of the container is in operatively engaged relation with the container engagement platform of the respective LC shuttle and the upper end of the container is in operatively engaged relation with the container engagement fixture of the respective UC shuttle, move the respective LC shuttle and the respective UC shuttle in coordinated relation in a first direction along the LC labeling track and UC labeling track respectively while holding the container in the shuttle engaged position, into the applicator position wherein the container is in operative engagement with the applicator, operate the applicator to apply at least one marking to the container in the applicator position and while the container is in the shuttle engaged position, move the marked container in the shuttle engaged position in the first direction away from the applicator position toward the LC outlet end, and release the container from operative engagement with the respective LC shuttle and the respective UC shuttle.

36. Apparatus comprising:

a machine that is operative to apply markings to containers, wherein each of the containers include a bottom end, and an upper portion disposed away from the bottom end, the machine including:

a lower conveyor (LC), wherein the LC includes a continuous LC track, wherein the LC track includes a substantially linearly straight, horizontally extending LC labeling track portion, wherein the LC labeling track portion extends from an LC inlet end to an LC outlet end, a return LC track portion, wherein the return LC track portion extends vertically below the LC labeling track portion, and from the LC outlet end to the LC inlet end, an upper conveyor (UC), wherein the UC includes a continuous UC track, wherein the UC track includes a substantially linearly straight, horizontally extending UC labeling track portion, wherein the UC labeling track portion is disposed vertically above and in aligned relation with the LC labeling track portion, extends intermediate of a UC inlet end and a UC outlet end, a return UC track portion, wherein the return UC track portion extends vertically above the UC labeling track portion, and from the UC outlet end to the UC inlet end, at least one LC shuttle, wherein each LC shuttle is in operative connection with the LC, is movable along the entire LC track, includes a container engagement platform, wherein the container engagement platform is configured to engage the bottom end of only one container, and is rotatably movable relative to the respective LC shuttle, at least one UC shuttle, wherein each UC shuttle is in operative connection with the UC, is movable along the entire UC track, includes a container engagement fixture thereon, wherein the container engagement fixture is configured to engage the upper portion of only one container, wherein each at least one LC shuttle or at least one UC shuttle includes a respective shuttle drive that is operative to cause movement of the respective at least one LC shuttle or at least one UC shuttle, wherein the respective LC track or UC track includes a spur that extends adjacent to the respective LC track or UC track, wherein the respective at least one LC shuttle or at least one UC shuttle is movable onto the spur and may remain stationary on the spur while at least one other LC shuttle or at least one other UC shuttle moves continuously around the respective LC track or UC track, an applicator, wherein the applicator is in an applicator position, wherein the applicator position is disposed adjacent to the LC labeling track portion and the UC labeling track portion, horizontally intermediate of the LC inlet end and the LC outlet end, is operative to apply at least one marking to a container in operative engagement with the applicator in the applicator position, wherein the machine is operative to move one respective LC shuttle and one respective UC shuttle into vertically aligned relation to engage the container in a shuttle engaged position, wherein in the shuttle engaged position the container is vertically between and in operative engagement with both the respective LC shuttle and the respective UC shuttle, wherein in the shuttle engaged position the bottom end of the container is in operatively engaged relation with the container engagement platform of the respective LC shuttle and the upper end of the container is in operatively engaged relation with the container engagement fixture of the respective UC shuttle, move the respective LC shuttle and the respective UC shuttle in coordinated relation in a first direction along the LC labeling track and UC labeling track respectively while holding the container in the shuttle engaged position, into the applicator position wherein the container is in operative engagement with the applicator, operate the applicator to apply at least one marking to the container in the applicator position and while the container is in the shuttle engaged position, move the marked container in the shuttle engaged position in the first direction away from the applicator position toward the LC outlet end, and release the container from operative engagement with the respective LC shuttle and the respective UC shuttle.

37. The apparatus according to claim 36 wherein each respective at least one LC shuttle or at least one UC shuttle includes a respective battery, wherein the battery is operative to power the respective shuttle drive, wherein the machine further includes a battery charger, wherein the battery charger is configured to charge the respective battery of the at least one LC shuttle or at least one UC shuttle on the spur.

38. Apparatus comprising:

a machine that is operative to apply markings to containers, wherein each of the containers include a bottom end, and an upper portion disposed away from the bottom end, the machine including:

a lower conveyor (LC), wherein the LC includes a continuous LC track, wherein the LC track includes a substantially linearly straight, horizontally extending LC labeling track portion, wherein the LC labeling track portion extends from an LC inlet end to an LC outlet end, a return LC track portion, wherein the return LC track portion extends vertically below the LC labeling track portion, and from the LC outlet end to the LC inlet end, an upper conveyor (UC), wherein the UC includes a continuous UC track, wherein the UC track includes a substantially linearly straight, horizontally extending UC labeling track portion, wherein the UC labeling track portion is disposed vertically above and in aligned relation with the LC labeling track portion, extends intermediate of a UC inlet end and a UC outlet end, a return UC track portion, wherein the return UC track portion extends vertically above the UC labeling track portion, and from the UC outlet end to the UC inlet end, at least one LC shuttle, wherein each LC shuttle is in operative connection with the LC and is movable along the entire LC track, wherein each LC shuttle includes a container engagement platform wherein the container engagement platform is configured to engage the bottom end of only one container, and is rotatably movable relative to the respective LC shuttle, at least one drive wherein the at least one drive is in operative connection with the container engagement platform, and is configured to selectively rotate and vertically move the container engagement platform, a wireless transceiver, wherein the wireless transceiver is in operative connection with the at least one drive, wherein the at least one drive is operative to cause rotation and vertical movement of the container engagement platform responsive at least in part to wireless signals received by the wireless transceiver, at least one UC shuttle, wherein each UC shuttle is in operative connection with the UC, is movable along the entire UC track, includes a container engagement fixture thereon, wherein the container engagement fixture is configured to engage the upper portion of only one container an applicator, wherein the applicator is in an applicator position, wherein the applicator position is disposed adjacent to the LC labeling track portion and the UC labeling track portion, and horizontally intermediate of the LC inlet end and the LC outlet end, is operative to apply at least one marking to a container in operative engagement with the applicator in the applicator position, wherein the machine is operative to move one respective LC shuttle and one respective UC shuttle into vertically aligned relation to engage the container in a shuttle engaged position, wherein in the shuttle engaged position the container is vertically between and in operative engagement with both the respective LC shuttle and the respective UC shuttle, wherein in the shuttle engaged position the bottom end of the container is in operatively engaged relation with the container engagement platform of the respective LC shuttle and the upper end of the container is in operatively engaged relation with the container engagement fixture of the respective UC shuttle, move the respective LC shuttle and the respective UC shuttle in coordinated relation in a first direction along the LC labeling track and UC labeling track respectively while holding the container in the shuttle engaged position, into the applicator position wherein the container is in operative engagement with the applicator, operate the applicator to apply at least one marking to the container in the applicator position and while the container is in the shuttle engaged position, move the marked container in the shuttle engaged position in the first direction away from the applicator position toward the LC outlet end, and release the container from operative engagement with the respective LC shuttle and the respective UC shuttle.

39. Apparatus comprising:

a machine that is operative to apply markings to containers, wherein each of the containers include a bottom end, and an upper portion disposed away from the bottom end, the machine including:

a lower conveyor (LC), wherein the LC includes a continuous LC track, wherein the LC track includes a substantially linearly straight, horizontally extending LC labeling track portion, wherein the LC labeling track portion extends from an LC inlet end to an LC outlet end, a return LC track portion, wherein the return LC track portion extends vertically below the LC labeling track portion, and from the LC outlet end to the LC inlet end, an upper conveyor (UC), wherein the UC includes a continuous UC track, wherein the UC track includes a substantially linearly straight, horizontally extending UC labeling track portion, wherein the UC labeling track portion
is disposed vertically above and in aligned relation with the LC labeling track portion,
extends intermediate of a UC inlet end and a UC outlet end,
a return UC track portion,
wherein the return UC track portion extends vertically above the UC labeling track portion, and from the UC outlet end to the UC inlet end,
at least one LC shuttle, wherein each LC shuttle
is in operative connection with the LC and
is movable along the entire LC track,
wherein each LC shuttle includes
a shuttle location sensor, wherein the shuttle location sensor is operative to provide signals usable to determine a current location of the LC shuttle on the LC track,
a container engagement platform
wherein the container engagement platform is configured to engage the bottom end of only one container, and
is rotatably movable relative to the respective LC shuttle,
a drive
wherein the drive is in operative connection with the container engagement platform, and is configured to selectively rotate the container engagement platform,
a wireless transceiver, wherein the wireless transceiver is in operative connection with the drive,
wherein the drive is operative to rotate the container engagement platform responsive at least in part to wireless signals received by the wireless transceiver,
at least one UC shuttle, wherein each UC shuttle
is in operative connection with the UC,
is movable along the entire UC track,
includes a container engagement fixture thereon,
wherein the container engagement fixture is configured to engage the upper portion of only one container
an applicator, wherein the applicator
is in an applicator position, wherein the applicator position is
disposed adjacent to the LC labeling track portion and the UC labeling track portion, and
horizontally intermediate of the LC inlet end and the LC outlet end,
is operative to apply at least one marking to a container in operative engagement with the applicator in the applicator position,
wherein the machine is operative to
move one respective LC shuttle and one respective UC shuttle into vertically aligned relation to engage the container in a shuttle engaged position, wherein in the shuttle engaged position the container is vertically between and in operative engagement with both the respective LC shuttle and the respective UC shuttle,
wherein in the shuttle engaged position the bottom end of the container is in operatively engaged relation with the container engagement platform of the respective LC shuttle and the upper end of the respective container is in operatively engaged relation with the container engagement fixture of the respective UC shuttle,
move the respective LC shuttle and the respective UC shuttle in coordinated relation in a first direction along the LC labeling track and UC labeling track respectively while holding the container in the shuttle engaged position, into the applicator position wherein the container is in operative engagement with the applicator,
operate the applicator to apply at least one marking to the container in the applicator position and while the container is in the shuttle engaged position,
move the marked container in the shuttle engaged position in the first direction away from the applicator position toward the LC outlet end, and
release the container from operative engagement with the respective LC shuttle and the respective UC shuttle.

40. The apparatus according to claim 39
and further comprising:
at least one optical sensor, wherein the at least one optical sensor is in operative connection with a controller including control circuitry and is disposed in the first direction from the applicator position,
wherein the at least one optical sensor is operative to sense at least one optical characteristic of the marking on the container applied by the applicator,
wherein the control circuitry includes a data store,
wherein the data store includes quality data, wherein the quality data corresponds to at least one of
a proper container application of the marking,
an improper container application of the marking,
wherein the controller is operative to cause rotation of the container in engagement with the container engagement platform while the at least one optical characteristic is sensed by the at least one optical sensor,
wherein the controller is operative responsive at least in part to the at least one optical characteristic sensed by the at least one optical sensor while the container is rotated and the quality data to cause
a determination of an improper container application of the at least one marking on the container,
responsive at least in part to the determination, generation of at least one signal that is operative to cause the container to be segregated from other containers having the at least one marking applied properly.

41. The apparatus according to claim 39
wherein the drive is further operative to vertically move the container engagement platform responsive at least in part to the wireless signals.

42. The apparatus according to claim 39
wherein the drive is operative to rotate the container engagement platform while the applicator is operative to apply the at least one marking to the container.

43. The apparatus according to claim 39
wherein the container engagement fixture is rotatable relative to the respective UC shuttle,
wherein each UC shuttle further includes
a further drive,
wherein the further drive is in operative connection with the container engagement fixture,
wherein the further drive is operative to selectively rotate the container engagement fixture.

44. The apparatus according to claim 39
wherein each LC shuttle further includes an LC shuttle drive, wherein the LC shuttle drive is operative to selectively move the LC shuttle relative to the LC shuttle track, wherein the LC shuttle drive is in operative connection with the wireless transceiver, wherein the LC shuttle drive is operative to move the LC shuttle relative to the LC shuttle track responsive at least in part to wireless signals received through the wireless transceiver.

45. Apparatus comprising:

a machine that is operative to apply markings to containers, wherein each of the containers include a bottom end, and an upper portion disposed away from the bottom end, the machine including:

a lower conveyor (LC), wherein the LC includes a continuous LC track, wherein the LC track includes a substantially linearly straight, horizontally extending LC labeling track portion, wherein the LC labeling track portion extends from an LC inlet end to an LC outlet end, a return LC track portion, wherein the return LC track portion extends vertically below the LC labeling track portion, and from the LC outlet end to the LC inlet end, an upper conveyor (UC), wherein the UC includes a continuous UC track, wherein the UC track includes a substantially linearly straight, horizontally extending UC labeling track portion, wherein the UC labeling track portion is disposed vertically above and in aligned relation with the LC labeling track portion, extends intermediate of a UC inlet end and a UC outlet end, a return UC track portion, wherein the return UC track portion extends vertically above the UC labeling track portion, and from the UC outlet end to the UC inlet end, at least one LC shuttle, wherein each LC shuttle is in operative connection with the LC and is movable along the entire LC track, wherein each LC shuttle includes an LC shuttle drive, wherein the LC shuttle drive is operative to selectively move the LC shuttle relative to the LC shuttle track, a wireless transceiver, wherein the LC shuttle drive is in operative connection with the wireless transceiver, wherein the LC shuttle drive is operative to move the LC shuttle relative to the LC shuttle track responsive at least in part to wireless signals received through the wireless transceiver, a container engagement platform, wherein the container engagement platform is configured to engage the bottom end of only one container, and is rotatably movable relative to the respective LC shuttle, a platform drive, wherein the platform drive is in operative connection with the container engagement platform, and is configured to selectively rotate the container engagement platform, wherein the platform drive is in operative connection with the wireless transceiver, wherein the platform drive is operative to rotate the container engagement platform responsive at least in part to wireless signals received by the wireless transceiver, at least one UC shuttle, wherein each UC shuttle is in operative connection with the UC, is movable along the entire UC track, includes a container engagement fixture thereon, wherein the container engagement fixture is configured to engage the upper portion of only one container, an applicator, wherein the applicator is in an applicator position, wherein the applicator position is disposed adjacent to the LC labeling track portion and the UC labeling track portion, and horizontally intermediate of the LC inlet end and the LC outlet end, is operative to apply at least one marking to a container in operative engagement with the applicator in the applicator position, wherein the machine is operative to move one respective LC shuttle and one respective UC shuttle into vertically aligned relation to engage the container in a shuttle engaged position, wherein in the shuttle engaged position the container is vertically between and in operative engagement with both the respective LC shuttle and the respective UC shuttle, wherein in the shuttle engaged position the bottom end of the container is in operatively engaged relation with the container engagement platform of the respective LC shuttle and the upper end of the respective container is in operatively engaged relation with the container engagement fixture of the respective UC shuttle, move the respective LC shuttle and the respective UC shuttle in coordinated relation in a first direction along the LC labeling track and UC labeling track respectively while holding the container in the shuttle engaged position, into the applicator position wherein the container is in operative engagement with the applicator, operate the applicator to apply at least one marking to the container in the applicator position and while the container is in the shuttle engaged position, move the marked container in the shuttle engaged position in the first direction away from the applicator position toward the LC outlet end, and release the container from operative engagement with the respective LC shuttle and the respective UC shuttle.

46. The apparatus according to claim 45 wherein each LC shuttle further includes a shuttle location sensor, wherein the shuttle location sensor is operative to provide signals usable to determine a current location of the LC shuttle on the LC track.

47. Apparatus comprising:

a machine that is operative to apply markings to containers, wherein each of the containers include a bottom end, and an upper portion disposed away from the bottom end, the machine including:

a lower conveyor (LC), wherein the LC includes a continuous LC track, wherein the LC track includes a substantially linearly straight, horizontally extending LC labeling track portion, wherein the LC labeling track portion extends from an LC inlet end to an LC outlet end, a return LC track portion, wherein the return LC track portion extends vertically below the LC labeling track portion, and from the LC outlet end to the LC inlet end, an upper conveyor (UC), wherein the UC includes a continuous UC track, wherein the UC track includes a substantially linearly straight, horizontally extending UC labeling track portion, wherein the UC labeling track portion is disposed vertically above and in aligned relation with the LC labeling track portion, extends intermediate of a UC inlet end and a UC outlet end, a return UC track portion, wherein the return UC track portion extends vertically above the UC labeling track portion, and from the UC outlet end to the UC inlet end, at least one LC shuttle, wherein each LC shuttle is in operative connection with the LC and is movable along the entire LC track, wherein each LC shuttle includes a container engagement platform, wherein the container engagement platform is configured to engage the bottom end of only one container, and is rotatably movable relative to the respective LC shuttle, a drive wherein the drive is in operative connection with the container engagement platform, and is configured to selectively rotate the container engagement platform, a wireless transceiver, wherein the wireless transceiver is in operative connection with the drive, wherein the drive is operative to rotate the container engagement platform responsive at least in part to wireless signals received by the wireless transceiver, at least one UC shuttle, wherein each UC shuttle is in operative connection with the UC, is movable along the entire UC track, includes a container engagement fixture thereon, wherein the container engagement fixture is configured to engage the upper portion of only one container, includes a UC shuttle drive, wherein the UC shuttle drive is operative to selectively move the UC shuttle relative to the UC shuttle track, includes a further wireless transceiver, wherein the UC shuttle drive is in operative connection with the further wireless transceiver, wherein the UC shuttle drive is operative to move the UC shuttle relative to the UC shuttle track responsive at least in part to wireless signals received through the further wireless transceiver, an applicator, wherein the applicator is in an applicator position, wherein the applicator position is disposed adjacent to the LC labeling track portion and the UC labeling track portion, and horizontally intermediate of the LC inlet end and the LC outlet end, is operative to apply at least one marking to a container in operative engagement with the applicator in the applicator position, wherein the machine is operative to move one respective LC shuttle and one respective UC shuttle into vertically aligned relation to engage the container in a shuttle engaged position, wherein in the shuttle engaged position the container is vertically between and in operative engagement with both the respective LC shuttle and the respective UC shuttle, wherein in the shuttle engaged position the bottom end of the container is in operatively engaged relation with the container engagement platform of the respective LC shuttle and the upper end of the respective container is in operatively engaged relation with the container engagement fixture of the respective UC shuttle, move the respective LC shuttle and UC shuttle in coordinated relation in a first direction along the LC labeling track and UC labeling track respectively while holding the container in the shuttle engaged position, into the applicator position wherein the container is in operative engagement with the applicator, operate the applicator to apply at least one marking to the container in the applicator position and while the container is in the shuttle engaged position, move the marked container in the shuttle engaged position in the first direction away from the applicator position toward the LC outlet end, and release the container from operative engagement with the respective LC shuttle and the respective UC shuttle.

48. Apparatus comprising:

a machine that is operative to apply markings to containers, wherein each of the containers include a bottom end, and an upper portion disposed away from the bottom end, the machine including:

a lower conveyor (LC), wherein the LC includes a continuous LC track, wherein the LC track includes a substantially linearly straight, horizontally extending LC labeling track portion, wherein the LC labeling track portion extends from an LC inlet end to an LC outlet end, a return LC track portion, wherein the return LC track portion extends vertically below the LC labeling track portion, and from the LC outlet end to the LC inlet end, an upper conveyor (UC), wherein the UC includes a continuous UC track, wherein the UC track includes a substantially linearly straight, horizontally extending UC labeling track portion, wherein the UC labeling track portion is disposed vertically above and in aligned relation with the LC labeling track portion, extends intermediate of a UC inlet end and a UC outlet end, a return UC track portion, wherein the return UC track portion extends vertically above the UC labeling track portion, and from the UC outlet end to the UC inlet end, at least one LC shuttle, wherein each LC shuttle
is in operative connection with the LC and
is movable along the entire LC track,
wherein each LC shuttle includes
a container engagement platform
wherein the container engagement platform is configured to engage the bottom end of only one container, and
is rotatably movable relative to the respective LC shuttle,
a drive
wherein the drive is in operative connection with the container engagement platform, and is configured to selectively rotate the container engagement platform,
a wireless transceiver, wherein the wireless transceiver is in operative connection with the drive,
wherein the drive is operative to rotate the container engagement platform responsive at least in part to wireless signals received by the wireless transceiver,
at least one UC shuttle, wherein each UC shuttle
is in operative connection with the UC,
is movable along the entire UC track,
includes a container engagement fixture thereon,
wherein the container engagement fixture is configured to engage the upper portion of only one container
wherein at least one of the LC shuttle track and the UC shuttle track includes a spur,
wherein at least one LC shuttle or at least one UC shuttle is movable into operative engagement with the spur,
wherein at least one other LC shuttle or at least one other UC shuttle is movable around the entire respective LC track or UC track while the at least one LC shuttle or at least one UC shuttle is stationary in operative engagement with the spur,
an applicator, wherein the applicator
is in an applicator position, wherein the applicator position is
disposed adjacent to the LC labeling track portion and the UC labeling track portion, and
horizontally intermediate of the LC inlet end and the LC outlet end,
is operative to apply at least one marking to a container in operative engagement with the applicator in the applicator position,
wherein the machine is operative to
move one respective LC shuttle and one respective UC shuttle into vertically aligned relation to engage the container in a shuttle engaged position, wherein in the shuttle engaged position the container is vertically between and in operative engagement with both the respective LC shuttle and the respective UC shuttle,
wherein in the shuttle engaged position the bottom end of the container is in operatively engaged relation with the container engagement platform of the respective LC shuttle and the upper end of the respective container is in operatively engaged relation with the container engagement fixture of the respective UC shuttle,
move the respective LC shuttle and UC shuttle in coordinated relation in a first direction along the LC labeling track and UC labeling track respectively while holding the container in the shuttle engaged position, into the applicator position wherein the container is in operative engagement with the applicator,
operate the applicator to apply at least one marking to the container in the applicator position and while the container is in the shuttle engaged position,
move the marked container in the shuttle engaged position in the first direction away from the applicator position toward the LC outlet end, and
release the container from operative engagement with the respective LC shuttle and the respective UC shuttle.

* * * * *